US008567937B2

(12) United States Patent
Fujioka et al.

(10) Patent No.: US 8,567,937 B2
(45) Date of Patent: Oct. 29, 2013

(54) IMAGE FORMING APPARATUS AND IMAGE FORMING METHOD

(75) Inventors: Masaya Fujioka, Nagoya (JP); Ryuji Kato, Kiyosu (JP); Hideji Fukaya, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 182 days.

(21) Appl. No.: 13/034,844

(22) Filed: Feb. 25, 2011

(65) Prior Publication Data

US 2011/0242242 A1 Oct. 6, 2011

(30) Foreign Application Priority Data

Mar. 31, 2010 (JP) ..... 2010-083226

(51) Int. Cl.
*B41J 2/01* (2006.01)

(52) U.S. Cl.
USPC ..... 347/102

(58) Field of Classification Search
USPC ..... 347/102
See application file for complete search history.

(56) References Cited

U.S. PATENT DOCUMENTS

| | | | | |
|---|---|---|---|---|
| 6,328,438 | B1 | 12/2001 | Ozawa | |
| 7,712,887 | B2 | 5/2010 | Kadomatsu et al. | |
| 7,828,411 | B2 | 11/2010 | Inoue et al. | |
| 2006/0033794 | A1 * | 2/2006 | Yamanobe | 347/102 |
| 2006/0055730 | A1 | 3/2006 | Ono et al. | |
| 2007/0024686 | A1 | 2/2007 | Kadomatsu et al. | |
| 2007/0200888 | A1 | 8/2007 | Inoue et al. | |
| 2007/0207412 | A1 * | 9/2007 | Aoshima | 430/302 |
| 2008/0199631 | A1 * | 8/2008 | Makuta et al. | 427/511 |
| 2008/0225080 | A1 | 9/2008 | Hirato | |

FOREIGN PATENT DOCUMENTS

| | | |
|---|---|---|
| JP | 11-348256 | 12/1999 |
| JP | 2000-108494 | 4/2000 |
| JP | 2002-331675 | 11/2002 |
| JP | 2002-332433 | 11/2002 |
| JP | 2004-188919 | 7/2004 |
| JP | 2004-202803 | 7/2004 |
| JP | 2005-186422 | 7/2005 |
| JP | 2006-110987 | 4/2006 |
| JP | 2007-030464 | 2/2007 |
| JP | 2007-229959 | 9/2007 |
| JP | 2007-230034 | 9/2007 |
| JP | 2007-296807 | 11/2007 |

(Continued)

OTHER PUBLICATIONS

Notice of Reasons for Rejections issued in corresponding Japanese Patent Application No. 2010-083226 dated Aug. 15, 2012.

*Primary Examiner* — Stephen Meier
*Assistant Examiner* — Tracey McMillion
(74) *Attorney, Agent, or Firm* — Banner & Witcoff, Ltd.

(57) ABSTRACT

There is provided an image forming apparatus for forming an image on a recording medium, the image forming apparatus including: a first discharge head which discharges, toward the recording medium, an ink containing a coloring agent; a second discharge head which discharges, toward the recording medium, a liquid which improves image quality and which contains a component for coagulating or depositing the coloring agent; an energy emitting device which emits active energy; and a transport mechanism which transports the recording medium to a position opposed to the first discharge head and the second discharge head, wherein: at least one of the ink and the liquid contains a curable substance which is curable by being irradiated with the active energy.

17 Claims, 13 Drawing Sheets

(56) References Cited

FOREIGN PATENT DOCUMENTS

| | | |
|---|---|---|
| JP | 2008-062433 | 3/2008 |
| JP | 2008-155464 | 7/2008 |
| JP | 2008-221715 | 9/2008 |
| JP | 2008-246993 | 10/2008 |
| JP | 2008-265324 | 11/2008 |

* cited by examiner

IMAGE FORMING APPARATUS AND IMAGE FORMING METHOD

CROSS REFERENCE TO RELATED APPLICATION

The present application claims priority from Japanese Patent Application No. 2010-083226, filed on Mar. 31, 2010, the disclosure of which is incorporated herein by reference in its entirety.

BACKGROUND OF THE INVENTION

1. Field of the Invention

The present invention relates to an image forming apparatus and an image forming method for forming an image on a recording medium.

2. Description of the Related Art

Japanese Patent Application Laid-open No. 11-348256 describes an ink-jet recording apparatus comprising a reaction liquid printing head and an ink composition printing head which are movable in the main scanning direction and a recording medium transport mechanism which transports a recording medium in the subsidiary scanning direction perpendicular to the scanning direction. In the ink-jet recording apparatus, a reaction liquid is discharged onto the recording medium from the reaction liquid printing head, and an ink composition is discharged onto the reaction liquid from the ink composition printing head. In this way, the ink composition and the reaction liquid are reacted with each other on the recording medium, and it is possible to form an image in which the color density is high and the blurring and the printing unevenness are suppressed.

However, in the ink jet recording apparatus described in Japanese Patent Application Laid-open No. 11-348256, a mist of the reaction liquid and a mist of the ink float in the apparatus when the reaction liquid is discharged from the reaction liquid printing head and when the ink composition is discharged from the ink composition printing head. As for the mists as described above, if the reaction liquid mist is adhered to the discharge surface of the ink composition printing head (portion at which discharge ports for discharging the ink composition are formed), and the reaction liquid mist is mixed with the ink composition existing in the vicinity of the discharge surface and the discharge ports, then a coloring agent of the ink composition is coagulated or deposited. On the other hand, if the ink mist is adhered to the discharge surface of the reaction liquid printing head, and the ink mist is mixed with the reaction liquid existing in the vicinity of the discharge surface and the discharge ports, then the coloring agent contained in the ink mist is coagulated or deposited. If the coloring agent is coagulated or deposited as described above, any solid matter is formed in the vicinity of the discharge surface and the discharge ports. Therefore, it is feared that the discharge may be disturbed or disordered for the reaction liquid and the ink composition.

In view of the above, an object of an aspect of the present teaching is to provide an image forming apparatus which makes it possible to suppress the coagulation or the deposition of a coloring agent in the vicinity of a discharge port.

SUMMARY OF THE INVENTION

According to a first aspect, there is provided an image forming apparatus for forming an image on a recording medium, the image forming apparatus including: a first discharge head which discharges, toward the recording medium, an ink containing a coloring agent; a second discharge head which discharges, toward the recording medium, a liquid which improves image quality and which contains a component for coagulating or depositing the coloring agent; an energy emitting device which emits active energy; and a transport mechanism which transports the recording medium to a position opposed to the first discharge head and the second discharge head, wherein:

at least one of the ink and the liquid contains a curable substance which is curable by being irradiated with the active energy.

According to a second aspect, there is provided an image forming method for forming an image on a recording medium, the image forming method including: discharging, toward the recording medium, an ink containing a coloring agent; discharging, toward the recording medium, a liquid which improves image quality and which contains a component for coagulating or depositing the coloring agent; and emitting active energy, wherein: at least one of the ink and the liquid contains a curable substance which is curable by being irradiated with the active energy.

According to the image forming apparatus concerning the aspect of the present teaching, the ink and/or the image quality improving liquid include/includes the curable substance. Therefore, the mist having the curable substance, which is included in the mists produced or generated by discharging the ink and the image quality improving liquid, is cured by being irradiated with the active energy. Accordingly, the coloring agent is hardly coagulated or deposited in the vicinity of at least one of the discharge ports of the ink discharge head and the image quality improving liquid discharge head. Therefore, at least one of the ink and the image quality improving liquid is discharged accurately, and it is possible to improve the quality of the image.

BRIEF DESCRIPTION OF THE DRAWINGS

FIG. 12 shows one of modified embodiments of the first embodiment, wherein

DESCRIPTION OF THE PREFERRED EMBODIMENTS

A preferred embodiment will be explained below with reference to the drawings.

First Embodiment

Image Forming Apparatus

Figure 1:
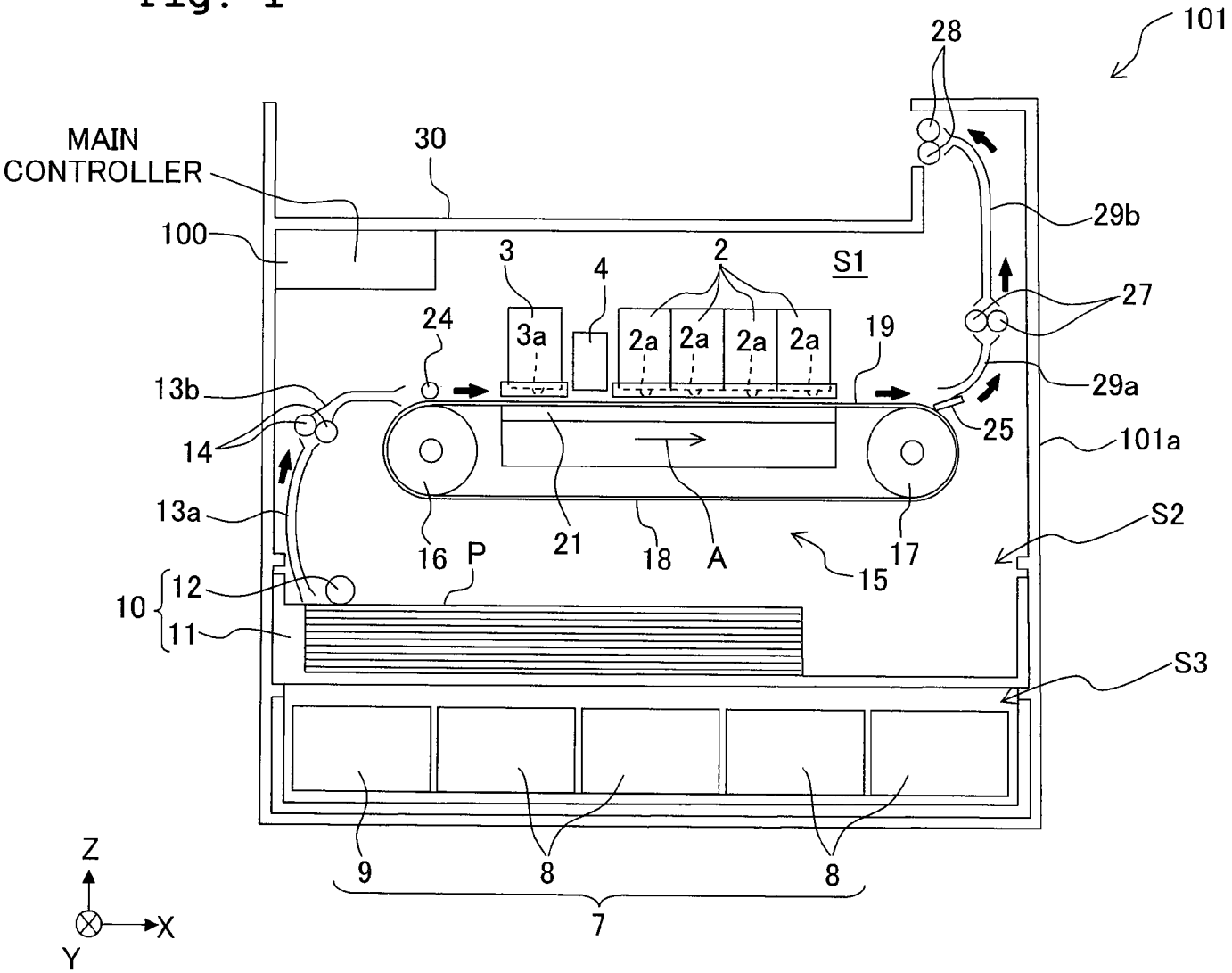
FIG. 1 shows a schematic side view illustrating an internal structure of an ink-jet printer according to a first embodiment.

As shown in FIG. 1, an ink-jet printer (image forming apparatus) 101 has a rectangular parallelepiped-shaped casing 101*a*, and it has a paper discharge section 30 provided at an upper portion. The interior of the casing 101*a* is comparted into three spaces S1 to S3 as referred to in this order from the top. Those arranged in the space S1 are four recording heads (ink discharge heads) 2 which discharge inks of magenta, cyan, yellow, and black respectively, a discharge head (image quality improving liquid discharge head) 3 which discharges an image quality improving liquid (hereinafter referred to as "improving liquid") for improving the image quality, an irradiation device 4 (energy emitting device) which emits or radiates the ultraviolet rays (ultraviolet light), and a transport mechanism 15 which transports the recording paper P to the position opposed to the recording heads and the discharge head. In this arrangement, it is assumed that the direction, in which the recording paper P is transported by the transport mechanism 15, is designated as the transport direction A, which is shown in FIG. 1. A paper feed unit 10 and a tank unit 7, which are installable/removable with respect to the casing 101*a*, are arranged in the spaces S2, S3 respectively. Four ink tanks 8 and one improving liquid tank 9 are accommodated in the tank unit 7. A main controller 100, which controls the operations of these components, are provided in the space S1.

In this embodiment, it is defined that the direction, which is parallel to the transport direction A when the recording paper P is transported by the transport mechanism 15, is the X direction, the direction, which is perpendicular to the X direction and which extends along the horizontal plane, is the Y direction, and the height direction, which is perpendicular to the X direction and the Y direction, is the Z direction.

Figure 2:
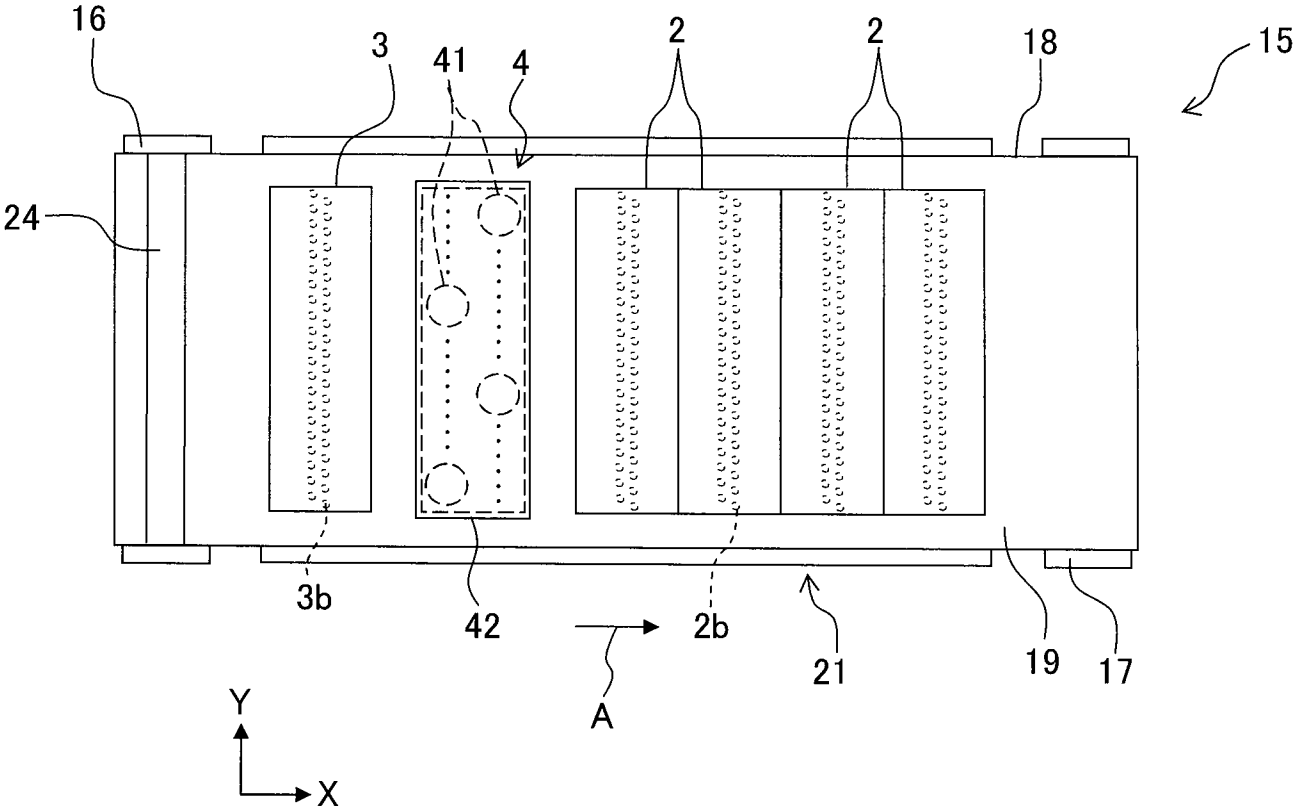
FIG. 2 shows a plan view illustrating a discharge head, an irradiation device, recording heads, and a transport mechanism shown in FIG. 1.

As shown in FIGS. 1 and 2, the five heads 2, 3 have substantially rectangular parallelepiped-shaped forms which are lengthy in the Y direction perpendicular to the transport direction A. The heads 2, 3 are arranged and fixed in the transport direction A of the recording paper P. Specifically, the discharge head 3 is arranged on the most upstream side in the transport direction A, and the four recording heads 2 are arranged on the downstream side of the discharge head 3. In other words, the printer 101 is a line type printer. The four recording heads 2 are arranged in such an order that the inks of cyan, magenta, yellow, and black are discharged, as referred to from the upstream side in the transport direction A. The transport mechanism 15 holds the recording medium P on a transport surface 19, and the transport mechanism 15 transports the recording medium P to the position opposed to the recording heads 2 and the discharge head 3. Therefore, the recording heads 2 and the discharge head 3 are arranged opposingly to the transport surface 19 of the transport mechanism 15.

The respective heads 2, 3, are constructed in the same manner provided that the liquids to be discharged (improving liquid and inks) are different from each other. Each of the heads 2, 3 has a stack (not shown as well) obtained by sticking or laminating a flow passage unit which is formed with ink flow passages including pressure chambers and an actuator which applies the pressure to the ink contained in the pressure chambers. A plurality of discharge ports 3*b*, which discharge the improving liquid, are arranged in the Y direction on the surface of the discharge head 3 opposed to the transport mechanism 15, i.e., on the discharge surface 3*a*. A plurality of discharge ports 2*b*, which discharge the ink, are arranged in the Y direction on the surface of the recording head 2 opposed to the transport mechanism 15, i.e., on the discharge surface 2*a*. The recording paper P is transported by the transport mechanism 15 to the position opposed to the discharge surfaces 2*a*, 3*a*. In this situation, the widths in the Y direction of the discharge surfaces 2*a*, 3*a* are larger than the width in the Y direction of the recording paper P. The discharge ports 2*b*, 3*b* are arranged on the discharge surfaces 2*a*, 3*a* within ranges which are not less than the width in the Y direction of the recording paper P. Therefore, the improving liquid and the inks can be discharged to the entire area of the recording paper P. The discharge surfaces 2*a*, 3*a* of the respective heads 2, 3 are arranged while being separated by about 1.5 mm in the Z direction from the transport surface 19 of a transport belt 18 for transporting the recording paper P.

The inks having the mutually different colors are stored in the four ink tanks 8. The improving liquid for improving the image quality is stored in the improving liquid tank 9. The inks of cyan, magenta, yellow, and black are supplied from the ink tanks 8 to the recording heads 2. The improving liquid is supplied from the improving liquid tank 9 to the discharge head 3. The tanks 8, 9 and the heads 2, 3 are connected by unillustrated flexible tubes.

The improving liquid, which is used in this embodiment, is composed of a component for coagulating a pigment as the coloring agent contained in the ink, a humectant agent, a surfactant, a curable substance, a polymerization initiator, and water. The component for coagulating the pigment is exemplified by cationic compound such as multivalent metal salt, cationic polymer, cationic surfactant and cationic fine particle. In this embodiment, calcium nitrate, which is multivalent metal salt, is used. The improving liquid is brought in contact with the pigment contained in the ink, and the pigment is coagulated thereby. Accordingly, the ink can be easily fixed on the recording paper P. The curable substance is such a substance that the substance is subjected to the curing as caused with the base point or start point at which the polymerization initiator begins the reaction by being irradiated with the ultraviolet rays (ultraviolet light).

In this embodiment, the curable substance is not specifically limited provided that the curable substance is water-soluble. The curable substance may be either a single compound or a mixture of a plurality of compounds. The curable substance is exemplified by acrylate, epoxy compound, phenol compound, unsaturated polyester, polyimide, polyurethane and oxetane compound, etc. In view of tight adhesion to the paper P, it is preferable to use a compound obtained by an addition reaction of a multifunctional epoxy composition and an amino group-containing maleimide compound. For example, it is possible to adopt two curable substances K1, K2 as shown in Table 1. Each of the curable substances K1, K2 is a compound obtained by an addition reaction of a multifunctional epoxy composition (EHPE 3150, produced by Daicel Chemical Industries, Ltd.) and an amino group-containing maleimide compound shown in Table 1. In this embodiment, the reaction, purification and isolation for obtaining the curable substances were performed by a conventional method.

TABLE 1

| | Multifunctional epoxy compound | Amino group-containing maleimide compound |
|---|---|---|
| Curable substance K1 | EHPE 3150 produced by Daicel Chemical Industries, Ltd. | 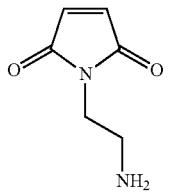 |
| Curable substance K2 | EHPE 3150 produced by Daicel Chemical Industries, Ltd. | 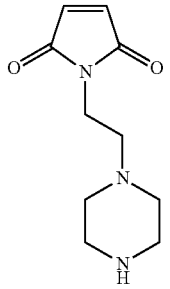 |

The polymerization initiator is not specifically limited as well provided that the polymerization initiator is water-soluble. It is possible to adopt, for example, any one of two polymerization initiators J1, J2 represented by the following formulas [J1] and [J2].

[J1]

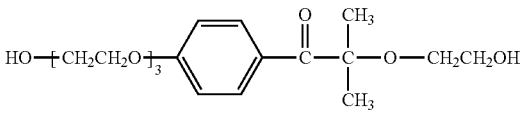

[J2]

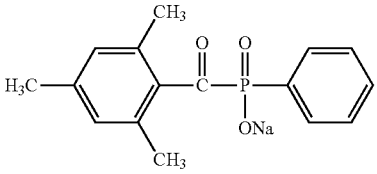

The improving liquid is prepared such that the components contained as described above are mixed respectively in predetermined blending amounts and they are sufficiently agitated, after which the filtration is performed while applying the pressure by using a filter. The improving liquid prepared as described above is a transparent liquid.

On the other hand, each of the four color inks used in this embodiment is composed of a pigment as the coloring agent, a humectant, a surfactant, a curable substance, a polymerization initiator, and water. In other words, the curable substance is contained in both of the inks and the improving liquid in this embodiment. The polymerization initiator and the curable substance contained in the ink are the same as or equivalent to those for constructing the improving liquid. Therefore, when the inks and the improving liquid are irradiated with the ultraviolet rays (ultraviolet light), the inks and the improving liquid are cured. The four color inks of this embodiment can be prepared in accordance with any known method. For example, the four color inks of this embodiment can be prepared such that the respective components contained as described above are mixed in predetermined blending amounts and they are sufficiently agitated, after which the filtration is performed by using a filter. The content of the curable substance contained in each of the improving liquid and the inks is preferably 1 to 30 wt %, and more preferably is 10 to 20 wt %. When the amount of addition of the curable substance is within this range, then the increase in the viscosities of the improving liquid and the inks can be suppressed to be within a range in which no influence is exerted on the discharge, and the improving liquid mist and the ink mists can be sufficiently cured by being irradiated with the ultraviolet rays.

Figure 3:
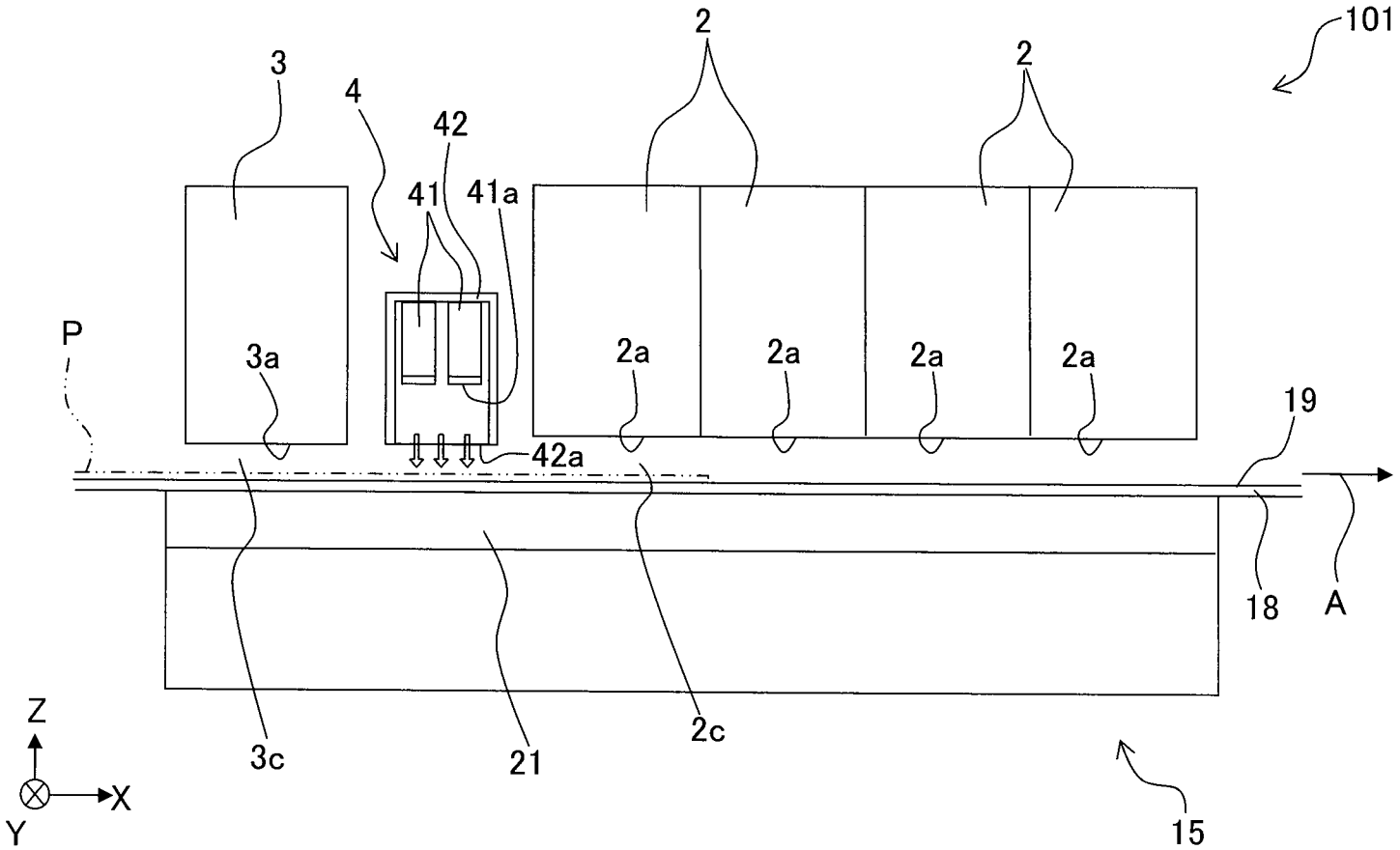
FIG. 3 shows a side view illustrating main components of the printer shown in FIG. 1.

As shown in FIGS. 2 and 3, the irradiation device 4 includes a plurality of light sources 41, a casing 42 which accommodates the light sources 41, and a light source controller (not shown) to which the plurality of light sources 41 are connected. A head (ANUJ 6160: light source 41) and a controller (ANUJ 5024) based on the LED system of Aicure UJ20 Series produced by Panasonic Electric Works Co., Ltd. are adopted for the light sources 41 and the light source controller of the irradiation device 4 in this embodiment. However, it is also allowable to use any ultraviolet ray irradiation device other than the above. The head based on the LED system is used for the light source 41. However, an ultraviolet ray irradiation device (EXECURE 3000) based on the use of a UV lamp produced by HOYA CANDEO OPTRONICS may be used as the light sources 41 and the light source controller of the irradiation device 4. It is allowable to appropriately make the selection. The light source controller is connected to the main controller 100. The light sources 41 are controlled so that the ultraviolet rays (ultraviolet light) are radiated from the light sources 41 on the basis of the control of the main controller 100.

The casing 42 has a rectangular parallelepiped-shaped box form having a light radiation port (active energy emitting port) 42*a* which is open downwardly, i.e., toward the transport surface 19 of the transport belt 18. The plurality of light sources 41 are fixed therein. The light sources 41 are arranged while being directed downwardly so that the radiation surfaces 41*a* are opposed to the transport surface 19. The light source 41 is arranged so that the separation distance in the vertical direction (Z direction) between the radiation surface 41*a* and the transport surface 19 is about 10 mm. As a result, in this embodiment, the radiation intensity of the ultraviolet rays (ultraviolet light) is 8000 mW/cm$^2$ with respect to the recording paper P transported by the transport surface 19. The radiation intensity of the ultraviolet rays (ultraviolet light) may be a radiation intensity of such an extent that the mists can be cured when the improving liquid mist and the ink mists are allowed to pass through the irradiation area of the ultraviolet rays (ultraviolet light). The plurality of light sources 41 are arranged in a staggered form at equal intervals in the Y direction. When the light sources are arranged in the staggered form as described above, it is possible to increase a number of the light sources per unit area and to radiate the ultraviolet rays uniformly. Further, in this embodiment, the four light sources 41 are adopted per 1 inch width in the Y direction of each of the heads 2, 3.

As described above, the recording heads 2, the discharge head 3, and the irradiation device 4 are arranged opposingly to the transport mechanism 15, and they are arranged in the X direction (transport direction A). As shown in FIGS. 2 and 3, the irradiation device 4 is arranged between the discharge head 3 and the recording head 2 which is disposed on the most upstream side. The ultraviolet rays (ultraviolet light) are radiated from the upward to the downward, i.e., toward the transport surface 19 between the heads 2, 3. In other words, the ultraviolet rays (ultraviolet light) are radiated from the central area between the adjoining heads 2, 3 onto the transport surface 19 while passing through the space between the heads 2, 3 and passing through the space between the area (first area) 2*c* which is disposed between the transport surface 19 and the discharge surface 2*a* of the recording head 2 and the area (second area) 3*c* which is disposed between the transport surface 19 and the discharge surface 3*a* of the discharge head 3.

As for the irradiation device, there is no limitation to the ultraviolet rays (ultraviolet light) provided that it is possible to apply the energy to cure the curable substance contained in the inks and the improving liquid. For example, it is also allowable to radiate the active energy beam including, for example, the α-ray, the γ-ray, the X-ray, the visible light beam (visible light), and the electron beam. Alternatively, it is also allowable to use those which apply the heat. As for the active energy, there is no limitation to the radiation of the ultraviolet rays (ultraviolet light). However, the active energy beam is preferred in view of the easiness of the control of the irradiation area. In particular, it is preferable to use the ultraviolet rays (ultraviolet light) in view of the selectability of light source and curable substance which are widely used.

A recording paper transport passage, in which the recording paper P is transported, is formed from the paper feed unit 10 to the paper discharge section 30 in the ink-jet printer 101 (thick arrows shown in FIG. 1). The paper feed unit 10 includes a paper feed tray 11 which is capable of accommodating a plurality of sheets of the recording paper P, a paper feed roller 12 which is attached to the paper feed tray 11, and a paper feed motor (not shown) which is controlled by the main controller 100 and which rotates the paper feed roller 12. The paper feed roller 12 feeds the recording paper P which is disposed at the uppermost position in the paper feed tray 11. The recording paper P, which has been fed thereby, is fed to the transport mechanism 15 while being guided by guides 13*a*, 13*b* and being interposed by a pair of feed rollers 14.

The transport mechanism 15 includes two belt rollers 16, 17, the endless transport belt 18 which is wound therearound so that the transport belt 18 is stretched between the both rollers 16, 17, a platen 21 which supports the transport belt 18, and a transport motor (not shown) which rotates the belt roller 17. The two belt rollers 16, 17 are provided and aligned in the transport direction A.

As shown in FIG. 2, the width in the Y direction of the transport belt 18 is slightly larger than the widths of the recording heads 2, the discharge head 3, and the irradiation device 4.

The width in the Y direction of the platen 21 is slightly longer than the lengths of the recording paper P and the transport belt 18.

As shown in FIG. 1, the upper surface of the platen 21 is brought in contact with the inner circumferential surface of the upper loop of the transport belt 18 which is supported thereby from the inner circumferential side of the transport belt 18. Accordingly, the transport surface 19 of the upper loop of the transport belt 18 is parallel to the discharge surfaces 2*a* of the recording heads 2 and the discharge surface 3*a* of the discharge head 3 while being opposed thereto. Further, a slight gap is formed between the discharge surfaces 2*a*, 3*a* and the transport surface 19. The gap forms a part of the recording paper transport passage.

A holding roller 24 is arranged at a position opposed to the belt roller 16 with the transport belt 18 intervening therebetween. The holding roller 24 is urged with respect to the transport surface 19 of the transport belt 18 by an elastic member such as a spring or the like. The recording paper P, which is fed from the paper feed unit 10, is pressed thereby against the transport surface 19. The holding roller 24 is a driven roller which is rotated in accordance with the rotation of the transport belt 18.

In this arrangement, the transport belt 18 is rotated by rotating the belt roller 17 clockwise as shown in FIG. 1 in accordance with the control of the main controller 100. In this situation, the belt roller 16 and the holding roller 24 are also rotated in accordance with the rotation of the transport belt 18. When the recording paper P, which is transported while being held on the transport surface 19 of the transport belt 18, is successively allowed to pass through the positions disposed just under the discharge head 3 and the four recording heads 2, the main controller 100 controls the respective heads 2, 3 to discharge the improving liquid and the inks of the respective colors toward the recording paper P. In other words, the improving liquid is firstly discharged toward the upper surface (printing surface) of the recording paper P, and then the inks of the respective colors are successively discharged. In this way, a color image is formed on the recording paper P in which the improving liquid has been adhered to the printing surface.

An exfoliating member 25 is provided just downstream from the transport mechanism 15 in the transport direction A. The exfoliating member 25 exfoliates the recording paper P from the transport surface 19 such that the forward end thereof enters the space between the recording paper P and the transport belt 18.

Two pairs of feed rollers 27, 28 and two pairs of guides 29*a*, 29*b* are arranged between the transport mechanism 15 and the paper discharge section 30 along the transport passage. The pairs of feed rollers 27, 28 are driven in accordance with the control of the main controller 100. The recording paper P, which is exfoliated from the transport surface 19, is allowed to pass through the guides 29*a*, 29*b* while being interposed by the pairs of feed rollers 27, 28, and the recording paper P is fed to the paper discharge section 30.

Figure 4:
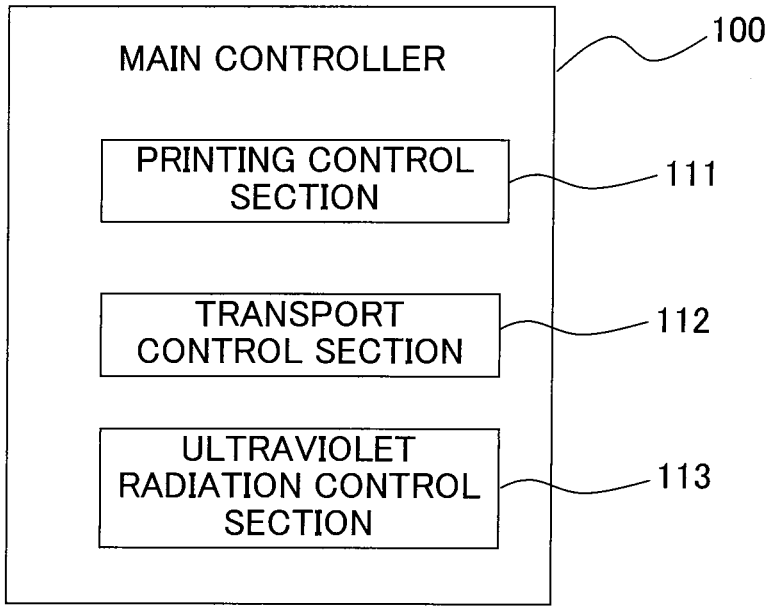
FIG. 4 shows a block diagram illustrating a schematic arrangement of a main controller shown in FIG. 1.

Next, the main controller 100 will be explained. The main controller 100 is composed of, for example, a general purpose personal computer. Such a computer accommodates the hardware including, for example, CPU, ROM, RAM and a hard disk. Various types of software are stored on the hard disk, which include, for example, programs for controlling the operation of the printer 101. Respective sections 111 to 113 (see FIG. 4) are constructed as described later on by combining the hardware and the software.

The main controller 100 includes a printing control section 111, a transport control section 112, and an ultraviolet radiation control section 113. The printing control section 111 controls the ink discharge from the respective recording heads 2 and the improving liquid discharge from the discharge head 3 so that the inks are discharged to the recording paper P on the basis of the printing data transmitted from an unillustrated host computer. In this procedure, the improving liquid is discharged from the discharge head 3 so that the improving liquid is landed on all of the landing positions on the recording paper P on which the inks discharged from the four recording heads 2 are to be landed. In this procedure, the printing control section 111 controls the discharge head 3 and the respective recording heads 2 so that the discharge of the inks is started for the recording paper P after the elapse of predetermined period of time after the recording paper P is fed from the paper feed unit 10. The predetermined period of time referred to herein is the period of time obtained such that the distance, which is provided along the transport passage from the paper feed unit 10 to the discharge port 3*b* disposed on the most upstream side of the discharge head 3, is divided by the transport velocity of the recording paper P.

The transport control section 112 controls the paper feed unit 10, the transport mechanism 15, and the feed roller pairs 14, 17, 28 so that the recording paper P is transported from the paper feed unit 10 to the paper discharge section 30.

The ultraviolet radiation control section 113 controls the controller to radiate the ultraviolet rays (ultraviolet light) from the light sources 41 for a predetermined radiation time when the control is performed by the printing control section 111 to discharge the improving liquid and the inks with respect to the recording paper P. The predetermined period of time may be not less than the period of time which is obtained such that the period of time, in which the improving liquid mist and the ink mists are cured by the ultraviolet rays (ultraviolet light) radiated from the irradiation device 4 after the completion of the driving of all of the discharge head 3 and the respective recording heads 2, is added to the driving period of time which ranges from the start of the driving of any one of the discharge head 3 and the respective recording heads 2 to the completion of the driving of all of the discharge head 3 and the respective recording heads 2. In this case, the radiation start timing may be provided immediately after the start of the driving of any one of the discharge head 3 and the respective recording heads 2. The start of the radiation may be brought about before the driving of any one of the discharge head 3 and the respective recording heads 2 as well.

Image Forming Method

Figure 5:
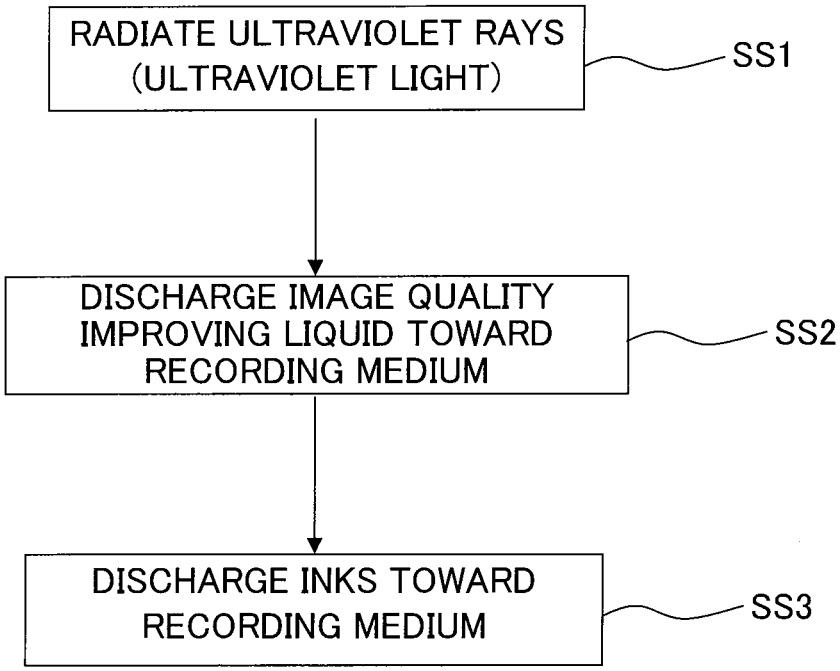
FIG. 5 shows a flow chart illustrating the printing operation (image forming method) performed by the ink-jet printer in the first embodiment.

Next, the printing operation (image forming method) performed by the printer 101 will be explained below with reference to FIG. 5. When the main controller 100 receives the printing data transmitted from the host computer, the transport control section 112 controls the paper feed unit 10 so that the recording paper P is fed from the paper feed tray 11. In this procedure, the transport control section 112 controls and drives the feed roller pairs 14, 27, 28 so that the recording paper P can be transported. Further, in this procedure, the transport control section 112 controls the transport mechanism 15 so that the transport belt 18 is allowed to travel in the transport direction A to successfully hold the recording paper P on the transport surface 19. In this way, the recording paper P, which is fed from the paper feed unit 10, is fed to the transport mechanism 15, and the recording paper P is transported in the transport direction A while being held by the transport surface 19.

In this procedure, the ultraviolet radiation control section 113 may control the light source controller so that the ultraviolet rays (ultraviolet light) are radiated from the respective light sources 41 for the predetermined radiation time (Step SS1).

Subsequently, the printing control section 111 controls the discharge head 3 so that the improving liquid is discharged from the discharge head 3 onto the recording paper P after the elapse of the predetermined period of time after the recording paper P is fed from the paper feed unit 10. In this way, the transparent image is formed by the improving liquid at the desired position on the surface of the recording paper P (Step SS2). After that, the printing control section 111 controls the respective recording heads 2 so that the inks are discharged from the respective recording heads 2 onto the transparent image formed on the surface of the recording paper P. Thus, the color image is formed on the recording paper P onto which the improving liquid has been discharged (Step SS3).

In this procedure, the recording paper P, onto which the improving liquid has been discharged, is allowed to pass through the area which is irradiated with the ultraviolet rays (ultraviolet light) radiated from the irradiation device 4. Therefore, a part of the improving liquid, which is disposed in the vicinity of the surface thereof, begins to be cured by the ultraviolet rays (ultraviolet light). However, the improving liquid is allowed to permeate into the inside of the recording paper P. Therefore, the pigments, which are contained in the inks discharged onto the improving liquid, are coagulated by the improving liquid disposed at the inside. Therefore, any blurring hardly occurs at the edge of the image, and the image having a dense density is obtained. The quality of the image is improved.

Even when the improving liquid mist, which is generated or produced by discharging the improving liquid from the discharge head 3, is moved from the area 3*c* toward the area 2*c* in accordance with the transport of the recording paper, the improving liquid mist is allowed to pass through the area which is irradiated with the ultraviolet rays (ultraviolet light) radiated from the irradiation device 4 until the improving liquid mist arrives at the area 2*c*. Therefore, the improving liquid mist arrives at the area 2*c* in a state of being cured. Therefore, even when the cured improving liquid mist is brought in contact with the inks, the coagulation of the pigments contained in the inks is suppressed. Therefore, any solid matter, which is produced by coagulating the pigments contained in the inks, is hardly formed on the discharge surfaces 2*a*.

Even when the ink mists, which are generated or produced by discharging the inks from the recording heads 2, are moved from the area 2*c* toward the area 3*c*, the ink mists are allowed to pass through the area which is irradiated with the ultraviolet rays (ultraviolet light) radiated from the irradiation device 4 until the ink mists arrive at the area 3*c*, in the same manner as the improving liquid mist. Therefore, the ink mists arrive at the area 3*c* in a state of being cured. Therefore, even when the cured ink mists are brought in contact with the improving liquid, the coagulation of the pigments contained in the inks is suppressed. Therefore, any solid matter, which is produced by coagulating the pigments contained in the inks, is hardly formed on the discharge surface 3*a*.

After that, the recording paper P, on which the image has been formed, is discharged to the paper discharge section 30 by the feed roller pairs 27, 28. Thus, the printing operation performed by the printer 101 comes to an end.

As described above, according to the ink jet printer 101 of this embodiment, the curable substance is contained in the improving liquid. Therefore, even when the mist, which is produced by the discharge of the improving liquid, flows toward the area 2*c* from the area 3*c* in accordance with the recording paper transport, the mist of the improving liquid is cured by the ultraviolet rays (ultraviolet light) radiated from the irradiation device 4 arranged between the discharge head 3 and the recording heads 2. When the improving liquid mist is cured as described above, even if the improving liquid mist is adhered to the discharge surfaces 2*a* of the recording heads 2 and the improving liquid mist is mixed with the inks, then it is possible to suppress the coagulation of the pigments contained in the inks, which would be otherwise caused by the improving liquid mist. Accordingly, the solid matter, which is produced by the coagulation of the pigments, is hardly formed in the vicinity of the discharge ports 2*b* of the recording heads 2. Therefore, the inks are discharged accurately, and it is possible to maintain the image quality.

In this embodiment, the curable substance is also contained in the inks. Therefore, even when the mists flow toward the area 3*c* from the area 2*c*, the ink mists are cured by the ultraviolet rays (ultraviolet light) radiated from the irradiation device 4. When the ink mists are cured as described above, even if the ink mists are adhered to the discharge surface 3*a* of the discharge head 3 and the ink mists are mixed with the improving liquid, then it is possible to suppress the coagulation of the pigments contained in the ink mists, which would be otherwise caused by the improving liquid. Accordingly, the solid matter, which is produced by the coagulation of the pigments, is hardly formed in the vicinity of the discharge ports 3*b* of the discharge head 3. Therefore, the improving liquid is discharged accurately, and the improving liquid is overlapped accurately with the inks discharged from the recording heads 2. Therefore, the blurring of the image formed on the recording paper P is suppressed, the optical density of the image (printed matter) is hardly lowered as well, and it is possible to maintain the image quality. As described above, in this embodiment, the curable substance is contained in both of the inks and the improving liquid. Therefore, the image quality is hardly disturbed, the blurring is suppressed as well, and the density of the image formed on the recording paper P is hardly lowered as well.

Even when the improving liquid and the ink mists, which are irradiated with the ultraviolet rays (ultraviolet light), are adhered to the discharge surfaces 2*a*, 3*a*, then the pigments contained in the inks are hardly coagulated on the discharge surfaces 2*a*, 3*a*, and the solid matter is hardly formed. Therefore, even when the discharge surfaces 2*a*, 3*a* are wiped with an unillustrated wiping mechanism (for example, a wiper), the discharge ports 2*b*, 3*b* are not clogged with the solid matter. Therefore, it is possible to suppress the occurrence of the discharge failure of the improving liquid and the inks to be discharged from the both heads 2, 3.

The ultraviolet rays (ultraviolet light), which are radiated from the irradiation device 4, are allowed to pass through the area disposed between the area 3*c* and the area 2*c*. Therefore, the improving liquid mist and the ink mists, which are allowed to pass between the areas 2*c*, 3*c*, can be effectively irradiated with the ultraviolet rays (ultraviolet light). Therefore, it is possible to reliably cure the mists. Even when the cured mists are adhered to the discharge surfaces 2*a*, 3*a* and the cured mists are brought in contact with the improving liquid and the inks, then the pigments contained in the inks are not coagulated.

The recording heads 2 are arranged downstream from the discharge head 3 in the transport direction A. The inks can be discharged onto the recording paper P on which the improving liquid discharged from the discharge head 3 has been landed. Therefore, the inks can be landed on the improving liquid on the recording paper P, and the pigments as the coloring agents can be effectively coagulated. Therefore, the optical density of the image (printed matter) is further improved.

The recording heads 2 and the discharge head 3 are constructed as the mutually different heads, i.e., the independent heads. Even when the recording heads 2 and the discharge head 3 are composed of the line heads, then the inks and the improving liquid are discharged accurately, and it is possible to maintain the quality of the image.

Owing to the provision of the transport mechanism 15, it is possible to transport the recording paper P in the transport direction A.

When the curable substance is contained in only one of the improving liquid and the inks as a modified embodiment, it is possible to obtain one type effect of those described above. The mist having the curable substance, which is any one of the mists produced by the discharge of the inks and the improving liquid, is cured by being irradiated with the active energy. Therefore, it is possible to maintain the image quality in any case. In particular, in a case that the curable substance is contained in only the improving liquid, it is possible to maintain the image quality. The improving liquid mist is cured, and thereby it is possible to suppress the occurrence of the discharge failure of the inks. In this case, there is a possibility that the discharge failure of the improving liquid might be occurred. However, the landing position of the transparent improving liquid is merely disturbed or deviated, and the landing position of the ink is not disturbed.

In this embodiment, the pigment is used as the coloring agent of the ink. However, it is also allowable to use a dye. In this case, when the improving liquid and the ink are brought in contact with each other, the dye as the coloring agent is deposited. Also in this case, it is possible to obtain the same effect as that obtained for the relationship between the improving liquid and the ink based on the use of the pigment as the coloring agent.

In another modified embodiment, it is also allowable that the discharge head 3 is arranged downstream from the four recording heads 2. Also in this case, when the improving liquid is landed on the landing position of the ink on the recording paper P onto which the ink has been discharged, it is possible to maintain the image quality. As for the mists of the inks and the improving liquid, the discharge head 3 is merely exchanged with the recording heads 2. Therefore, it is possible to obtain the same or equivalent effect.

In still another modified embodiment, the irradiation device 4 may be arranged while being inclined so that the ultraviolet rays (ultraviolet light), which are radiated from the light sources 41, are radiated onto the transport surface 19 at an angle of less than 90 degrees, for example, about 60 degrees. In other words, the ultraviolet rays (ultraviolet light) are radiated onto the surface of the recording paper P supported by the transport surface 19 at the angle of 60 degrees. When the ultraviolet rays (ultraviolet light) are radiated onto the recording paper P as described above, it is possible to suppress the radiation intensity per unit area of the ultraviolet rays (ultraviolet light) with respect to the improving liquid landed on the recording paper P.

In still another modified embodiment, an annular skirt member may be fixed to a lower end of each of the four recording heads 2. The skirt member is fixed to the side surface of the recording head 2, and the skirt member is arranged a position at which the lower end thereof protrudes toward the transport mechanism 15 as compared with the discharge surface 2*a*. Specifically, the skirt member is arranged such that the lower end thereof is separated by about 1 mm in the Z direction from the transport surface 19. Accordingly, the mist of the ink discharged from the recording head 2 is hardly moved to the outside of the skirt member. Therefore, the ink mist is hardly adhered to the discharge surface 3*a* of the discharge head 3.

In still another modified embodiment, an annular skirt member may be also fixed to a lower end of the discharge head 3. The skirt member is also fixed to the side surface of the discharge head 3, and the skirt member is arranged a position at which the lower end thereof protrudes toward the transport mechanism 15 as compared with the discharge surface 3*a*, in the same manner as the skirt member for the recording head 2 described above. Specifically, the skirt member is arranged such that the lower end thereof is separated by about 1 mm in the Z direction from the transport surface 19. Accordingly, the mist of the improving liquid discharged from the discharge head 3 is hardly moved to the outside of the skirt member. Therefore, the improving liquid mist is hardly adhered to the discharge surface 2*a* of the recording head 2.

Second Embodiment

Subsequently, an ink-jet printer 301 according to a second embodiment will be explained below with reference to FIGS. 6 to 8. In the printer 301 of this embodiment, an irradiation device 304 is constructed differently from the irradiation device 4 of the first embodiment. The other components or parts are approximately the same as those of the first embodiment. The components or parts, which are the same as or equivalent to those of the first embodiment, are designated by the same reference numerals, any explanation of which will be omitted.

Figure 6:
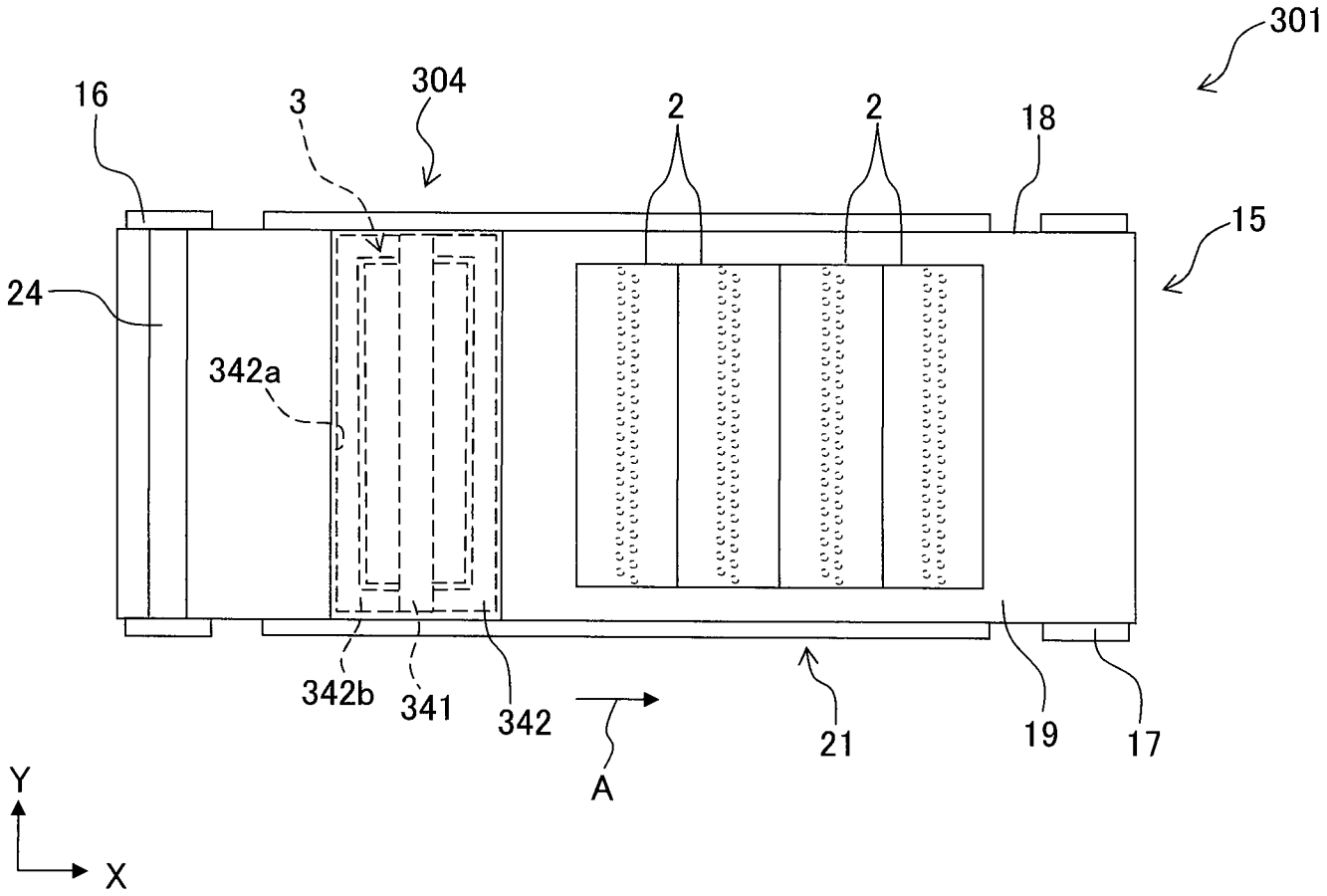
FIG. 6 shows a plan view illustrating main components of an ink jet printer according to a second embodiment.
Figure 7:
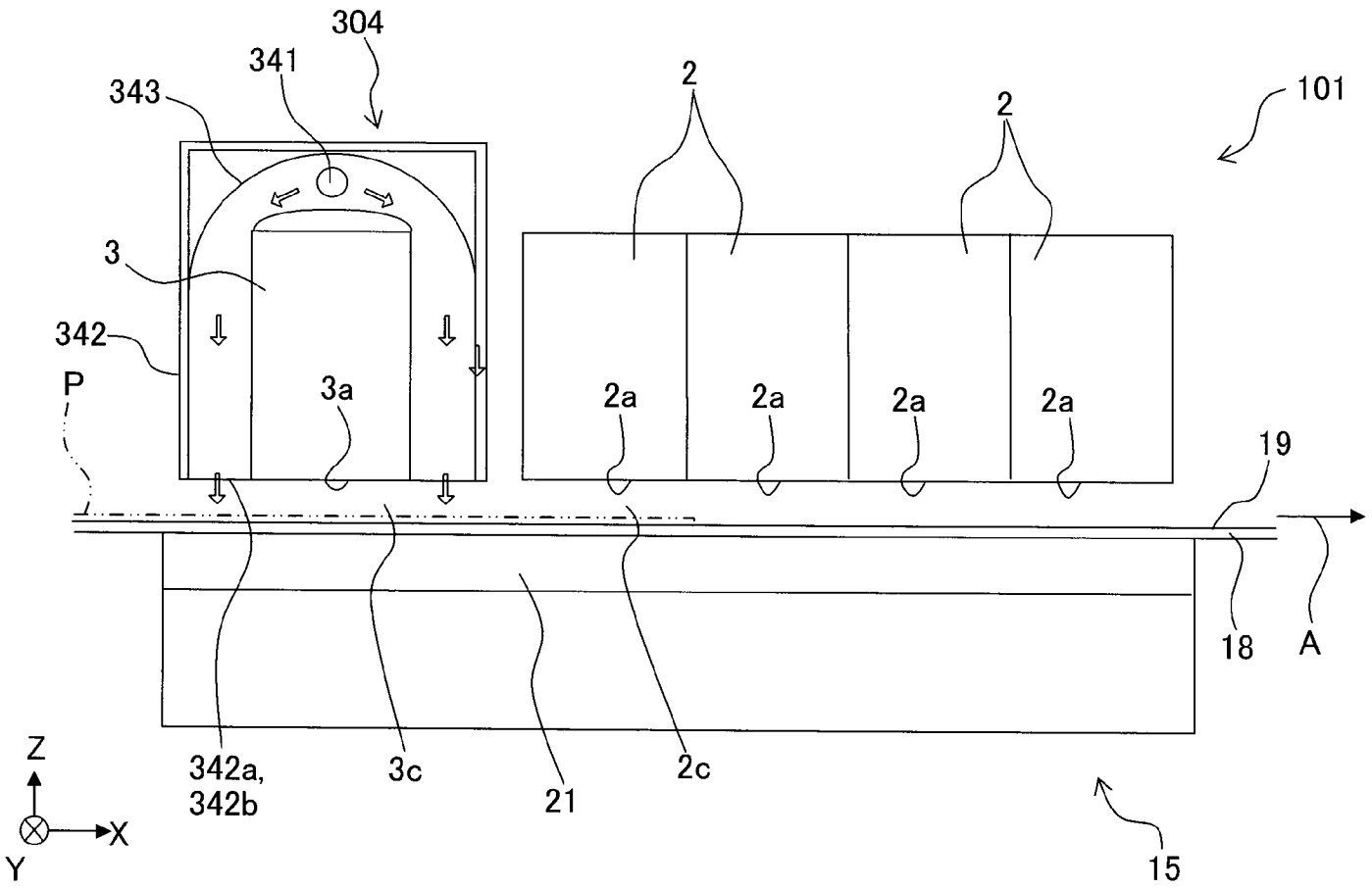
FIG. 7 shows a side view illustrating main components of the ink jet printer according to the second embodiment.
Figure 8:
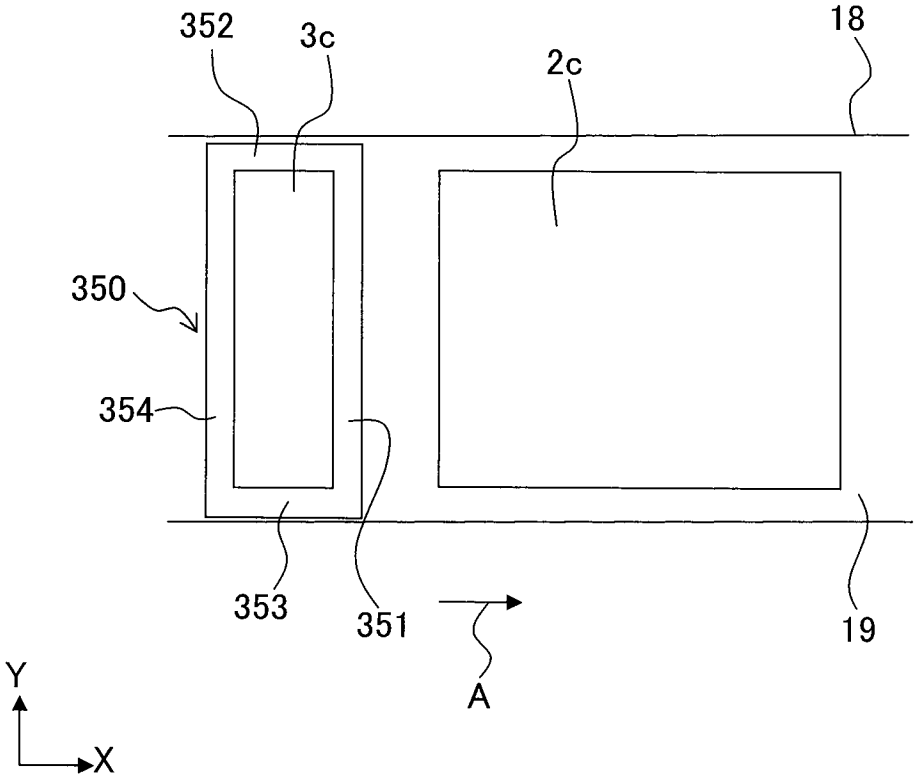
FIG. 8 illustrates areas disposed between respective discharge surfaces and a transport surface and an irradiation space through which the ultraviolet rays (ultraviolet light) are allowed to pass in the ink jet printer according to the second embodiment.

As shown in FIGS. 6 and 7, the irradiation device 304, which covers the discharge head 3 from the upper side (from the side opposed to the transport surface 19), is provided in the printer 301. The irradiation device 304 comprises a light source 341, a cover 342 which has an opening 342*a* formed at a position opposed to the transport surface 19 and which surrounds the surrounding of the discharge head 3, and a reflector 343 which is accommodated in the cover 342. In this embodiment, the discharge head 3 is accommodated in the opening 342*a* of the irradiation device 304. The discharge surface 3*a* is opposed to the transport surface 19 via the opening 342*a*. A straight tube type UV lamp, which extends in the Y direction, is used for the light source 341. The length in the Y direction of the light source 341 is longer than the length in the Y direction of the discharge head 3, which is approximately the same as the width in the Y direction of the transport belt 18. The light source 341 is also controlled by the light source controller (not shown). The light source controller is controlled by the main controller 100 in the same manner as in the first embodiment. In this embodiment, the straight tube type UV lamp is used for the light source 341. However, the light source may be constructed such that a plurality of the heads based on the LED system of the first embodiment may be arranged in the main scanning direction.

The reflector 343 is provided at the upper portion of the cover 342, which partially covers the surrounding of the light source 341. As shown in blank arrows in FIG. 7, the reflector 343 has a circular arc-shaped form so that the ultraviolet rays (ultraviolet light), which are radiated from the entire circumference of the light source 341, are reflected and the ultraviolet rays (ultraviolet light) are radiated from the opening 342*a*.

The discharge head 3 is accommodated in the opening 342*a*. Therefore, the ultraviolet rays (ultraviolet light), which are radiated from the light source 341, are directed toward the opening 342*a* by the reflector 343, and the ultraviolet rays (ultraviolet light) are radiated toward the transport surface 19 from the entire annular opening (light emitting port, active energy emitting port) 342*b* which surrounds the discharge surface 3*a* of the discharge head 3. In other words, as shown in FIG. 8, the ultraviolet rays (ultraviolet light) continuously pass in the circumferential direction through an annular irradiation space 350 which surrounds the entire surrounding of the area 3*c*. The irradiation space 350 is a cylindrical space which surrounds the entire surrounding of the discharge head 3 and the entire surrounding of the area 3*c*. As shown in FIG. 8, the irradiation space 350 has a first irradiation space 351 which is disposed between the area 2*c* and the area 3*c* and which extends in the Y direction, a second irradiation space 352 and a third irradiation space 353 which are arranged at positions to interpose the area 3*c* in the Y direction and which extend in the X direction, and a fourth irradiation space 354 which is arranged at a position to interpose the discharge head 3 and the area 3*c* together with the first irradiation space 351 and which extends in the Y direction. Any one of the first to fourth irradiation spaces 351 to 354 is arranged closely to the discharge head 3 and the area 3*c*, and the first to fourth irradiation spaces 351 to 354 are communicated with each other to form the annular irradiation space 350.

As described above, also in the printer 301 of this embodiment, the ultraviolet rays (ultraviolet light) are radiated to the space between the areas 2*c*, 3*c* during the printing in the same manner as in the first embodiment. Further, the inks and/or the improving liquid, in which the curable substance is contained, is/are discharged from at least one of the heads 2, 3. Therefore, the inks are discharged accurately, and it is possible to maintain the image quality. The same effect can be obtained with the arrangement which is the same as or equivalent to that of the first embodiment.

The width of the annular opening (light emitting port) 342*b* of the irradiation device 304 in the Y direction is longer than the widths of the discharge surfaces 2*a*, 3*a* of the recording heads 2 and the discharge head 3 respectively. In other words, the first irradiation space 351 of the irradiation space 350 is longer than the areas 2*c*, 3*c* in relation to the Y direction, and the ultraviolet rays (ultraviolet light) are allowed to pass through the entire first irradiation space 351. Therefore, it is possible to effectively cure both of the mists of the improving liquid and the inks. Therefore, the coagulated or deposited coloring agents in the inks are hardly adhered to the discharge surfaces 2*a*, 3*a*.

The annular opening 342*b*, which is the light emitting port for emitting the ultraviolet rays (ultraviolet light), is arranged while surrounding the discharge surface of the recording head 2. The ultraviolet rays (ultraviolet light) are allowed to pass through the irradiation space 350 in the vertical direction while being continued in the circumferential direction. Therefore, the ultraviolet rays (ultraviolet light) are allowed to pass through the entire circumference of the area 3*c*. In other words, the ultraviolet rays (ultraviolet light) surround the entire circumference of the area 3*c*. Therefore, it is possible to more effectively cure the improving liquid mist which intends to move from the area 3*c* to the outside and the ink mists which intend to move from the outside into the area 3*c*.

In the second embodiment, the ultraviolet rays (ultraviolet light) are radiated to surround the surrounding of the area 3*c*. However, it is enough to provide such an arrangement that the ultraviolet rays (ultraviolet light) can pass through at least any one space of the second to fourth irradiation spaces 352 to 354 provided that the ultraviolet rays (ultraviolet light) are radiated onto the first irradiation space 351. Also in this case, it is possible to effectively cure the both mists of the improving liquid and the inks. Further, it is possible to miniaturize and simplify the irradiation device 304.

Figure 9:
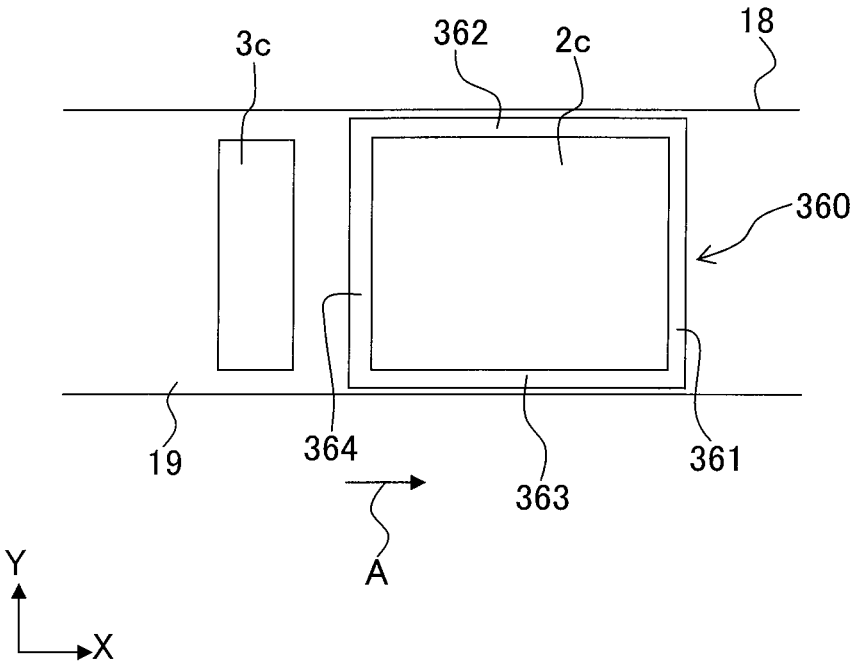
FIG. 9 shows a first modified embodiment of the ink-jet printer according to the second embodiment, illustrating areas disposed between respective discharge surfaces and a transport surface and an irradiation space through which the ultraviolet rays (ultraviolet light) are allowed to pass.

In a first modified embodiment of the second embodiment, as shown in FIG. 9, an irradiation device may be provided in the printer so that an irradiation space 360, which surrounds the surrounding of the area 2*c* opposed to the four recording heads 2, is constructed. The irradiation space 360 also has a cylindrical shape in the same manner as the irradiation space 350 described above. The irradiation space 360 is such a space that the ultraviolet rays (ultraviolet light) are allowed to pass therethrough toward the transport surface 19 while being continued in the circumferential direction.

The irradiation space 360 has a first irradiation space 361 which is arranged downstream from the area 2*c* in the transport direction A and which extends in the Y direction, a second irradiation space 362 and a third irradiation space 363 which are arranged at positions to interpose the area 2*c* in the Y direction and which extend in the X direction, and a fourth irradiation space 364 which is arranged at a position to interpose the recording heads 2 and the area 2*c* together with the first irradiation space 361 and which extends in the Y direction. Any one of the first to fourth irradiation spaces 361 to 364 is arranged closely to the recording heads 2 and the area 2*c*.

When the irradiation space 360 is constructed as described above, the ultraviolet rays (ultraviolet light) are allowed to pass through the entire circumference of the area 2*c*. In other words, the ultraviolet rays (ultraviolet light) surround the entire circumference of the area 2*c*. Therefore, it is possible to further cure the mists of the inks and the improving liquid. Further, the coloring agents contained in the inks, which are coagulated or deposited on the discharge surfaces 2*a*, 3*a*, are hardly adhered.

In the first modified embodiment, the ultraviolet rays (ultraviolet light) are radiated to surround the surrounding of the area 2*c*. However, it is enough to provide such an arrangement that the ultraviolet rays (ultraviolet light) can pass through at least any one space of the first to third irradiation spaces 361 to 363 provided that the ultraviolet rays (ultraviolet light) are radiated onto the fourth irradiation space 364. Also in this case, it is possible to effectively cure the both mists of the improving liquid and the inks. Further, it is possible to miniaturize and simplify the irradiation device.

Figure 10:
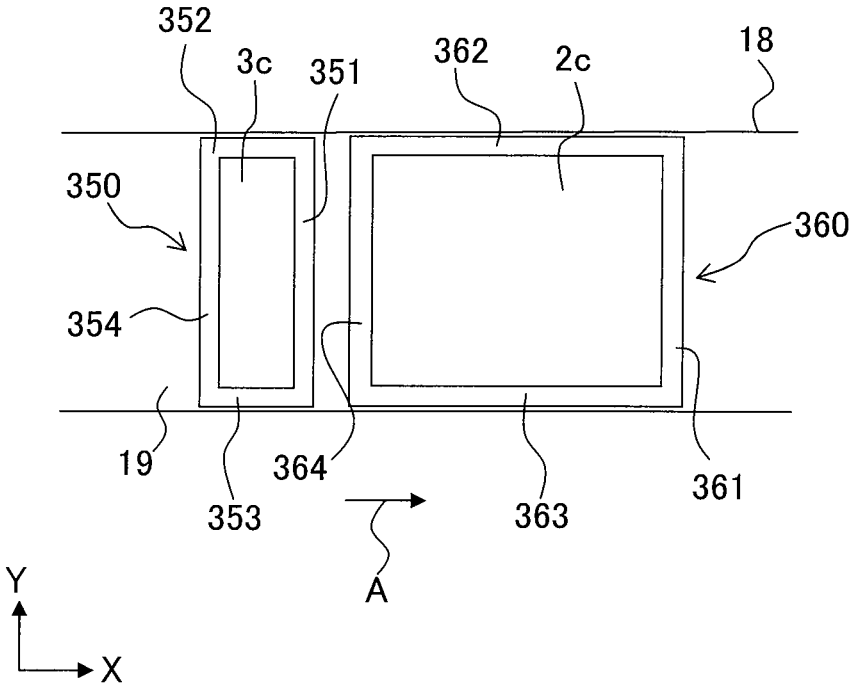
FIG. 10 shows a second modified embodiment of the ink jet printer according to the second embodiment, illustrating areas disposed between respective discharge surfaces and a transport surface and an irradiation space through which the ultraviolet rays (ultraviolet light) are allowed to pass.

In a second modified embodiment of the second embodiment, it is also allowable to provide a printer in which the second embodiment and the first modified embodiment thereof are combined. That is, as shown in FIG. 10, the two irradiation devices may be provided for the printer to construct the irradiation space 350 which surrounds the area 3*c* and the irradiation space 360 which surrounds the area 2*c*. In this case, the covers of the two irradiation devices surround the discharge head 3 and the four recording heads 2 respectively. The ultraviolet rays (ultraviolet light) are radiated onto the both irradiation spaces 350, 360. Therefore, it is possible to more effectively cure the both mists of the improving liquid and the inks.

In the second modified embodiment, the first irradiation space 351 and the fourth irradiation space 364 exist between the areas 2*c*, 3*c*. Therefore, it is also allowable to adopt such an arrangement that only any one of the first irradiation space 351 and the fourth irradiation space 364 exists. It is enough to provide such an arrangement that the ultraviolet rays (ultraviolet light) can pass through any one space of the fourth irradiation space 354 and the first irradiation space 361 and the second and third irradiation spaces 352, 353, 362, 363 provided that the ultraviolet rays (ultraviolet light) are radiated onto any one of the first irradiation space 351 and the fourth irradiation space 364. Further, it is enough to provide such an arrangement that the ultraviolet rays (ultraviolet light) can pass through only the second and third irradiation spaces 352, 353, 362, 363 on condition that the ultraviolet rays (ultraviolet light) are radiated onto any one of the first irradiation space 351 and the fourth irradiation space 364. Also in these cases, it is possible to effectively cure the both mists of the improving liquid and the inks. Further, it is possible to miniaturize and simplify the irradiation devices.

Third Embodiment

Subsequently, an explanation will be made below with reference to FIG. 11 about an ink-jet printer 401 according to a third embodiment. In the printer 401 of this embodiment, only an irradiation device 404 is constructed differently from the irradiation device 4 of the first embodiment. The other components or parts are approximately the same as those of the printer 101 of the first embodiment. The components or parts, which are the same as or equivalent to those of the first embodiment, are designated by the same reference numerals, any explanation of which will be omitted.

Figure 11:
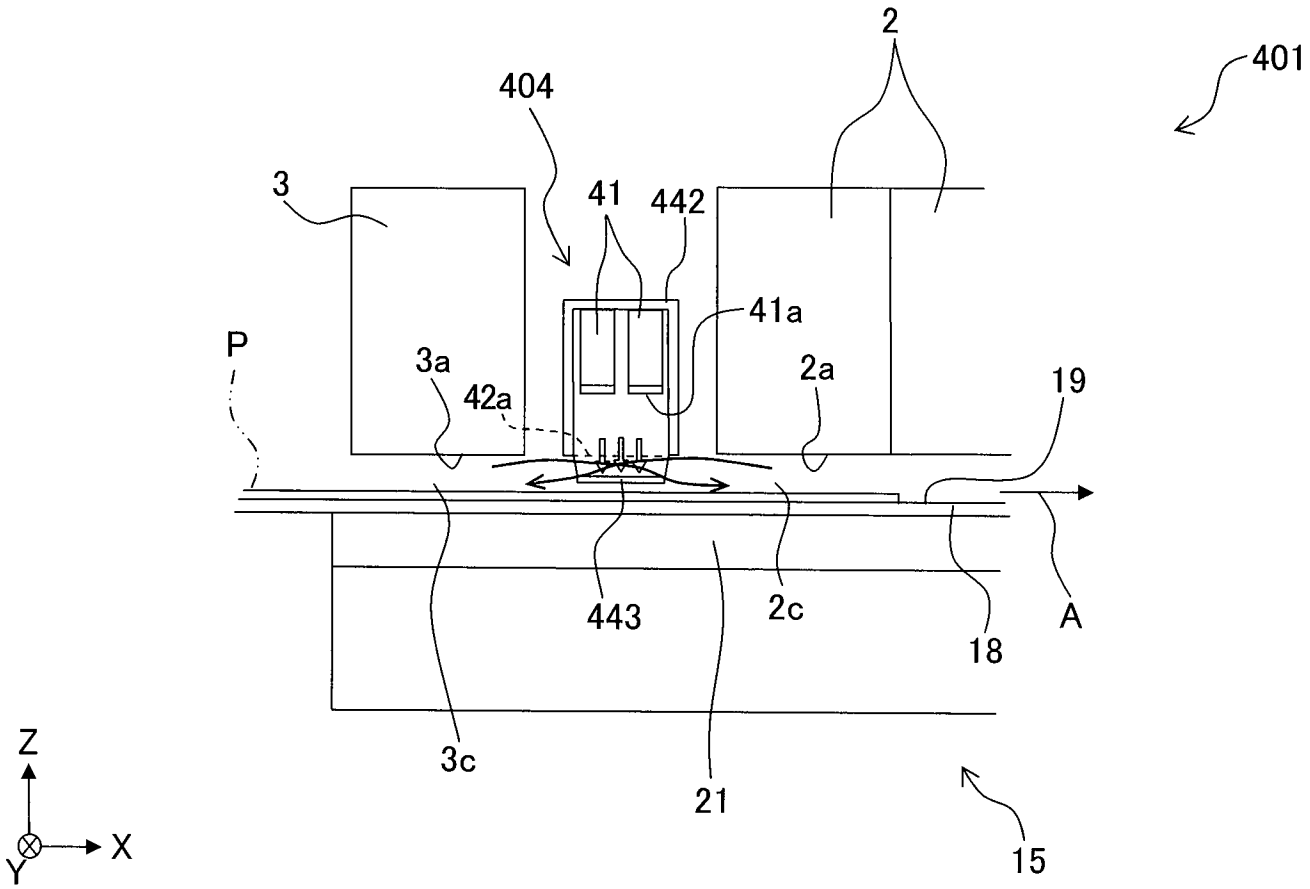
FIG. 11 shows a side view illustrating main components of an ink-jet printer according to a third embodiment.

As shown in FIG. 11, in the irradiation device 404 of this embodiment, a shield plate (shielding member) 443, through which the ultraviolet rays (ultraviolet light) radiated from the light sources 41 are not transmitted, is merely formed at a lower end of a casing 442 which is approximately the same as or equivalent to the casing 42 described above. The other components or parts are the same as or equivalent to those of the irradiation device 4 of the first embodiment. The shield plate 443 extends in a lengthy form in the Y direction. The shield plate 443 is arranged between the light emitting port (active energy emitting port) 42*a* and the transport surface 19 and between the areas 2*c*, 3*c*. In other words, the shield plate 443 is arranged at the position which is disposed nearer to the recording paper P held by the transport surface 19 as compared with the discharge surfaces 2*a*, 3*a* of the both heads 2, 3 on the optical path of the ultraviolet rays (ultraviolet light) radiated from the light sources 41. In this embodiment, the shield plate 443 is arranged while being separated by about 0.7 mm from the transport surface 19. However, the shield plate 443 may be arranged at any position provided that the separation distance is within a range of not less than 0.5 mm and less than 1.5 mm.

When the irradiation device 404 is provided with the shield plate 443 as described above, the mist of the improving liquid to move from the area 3*c* to the area 2*c* and the mists of the inks to move from the area 2*c* to the area 3*c* are allowed to pass over the shield plate 443 as shown by arrows in FIG. 11 during the printing. Therefore, it is possible to effectively cure the both mists. Further, the ultraviolet rays (ultraviolet light) are shielded by the shield plate 443 so that the improving liquid discharged onto the recording paper P is not irradiated with the ultraviolet rays (ultraviolet light). Therefore, the coloring agents contained in the inks, which are landed on the improving liquid, are effectively coagulated or deposited with the improving liquid. The optical density of the printed image (printed matter) is improved.

The same effect can be also obtained by the printer 401 of the third embodiment as described above in the arrangement which is the same as or equivalent to that of the first embodiment.

Preferred embodiments have been explained above. However, the aspect of the present teaching is not limited to the embodiments described above. It is possible to make various changes within a scope defined in claims. For example, in the embodiment described above, the recording paper P is transported by the transport based on the belt transport. However, it is also allowable to use any transport mechanism which makes it possible to perform various types of the recording paper transport including, for example, the transport by the air attraction, the transport based on the electrostatic attraction, the roller transport, and the belt transport based on the use of the stickiness of the transport belt. In the respective embodiments described above, the irradiation device is arranged at the position at which the space between the area 2*c* and the area 3*c* is interposed together with the transport surface 19, and the ultraviolet rays (ultraviolet light) are radiated onto the transport surface while passing through the space. However, the irradiation device may be arranged in the printer so that the ultraviolet rays (ultraviolet light) are radiated in the direction intersecting the transport direction A in the in-plane direction of the discharge surface to allow the ultraviolet rays (ultraviolet light) to pass through the space. Also in this case, it is possible to obtain the effect which is the same as or equivalent to that of the embodiment described above.

Figure 12A:
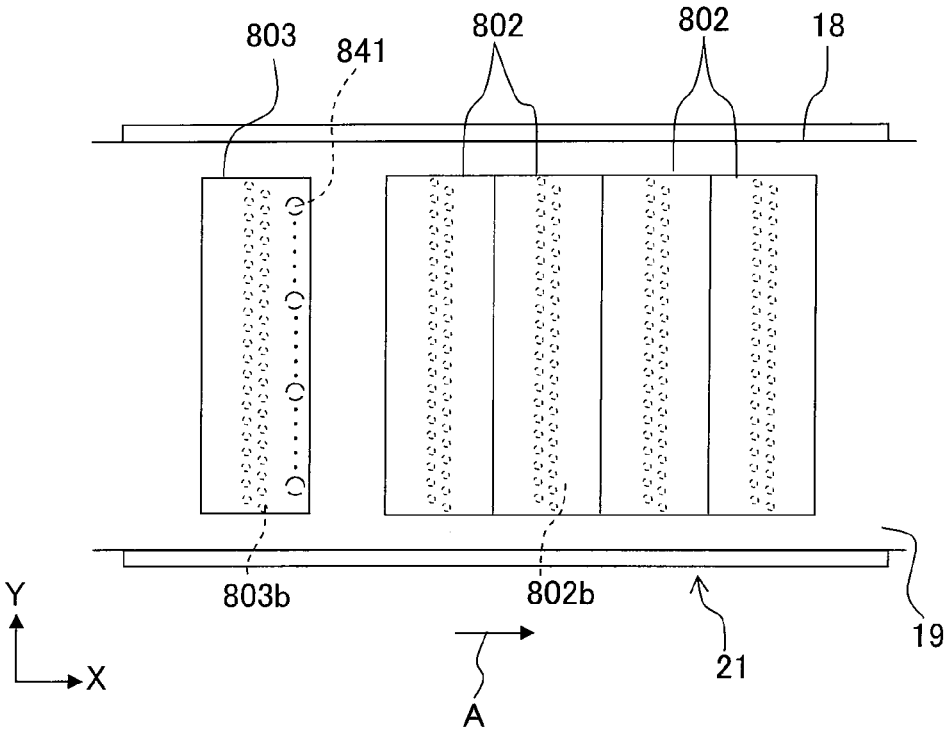
FIG. 12A shows a plan view illustrating main components.
Figure 12B:
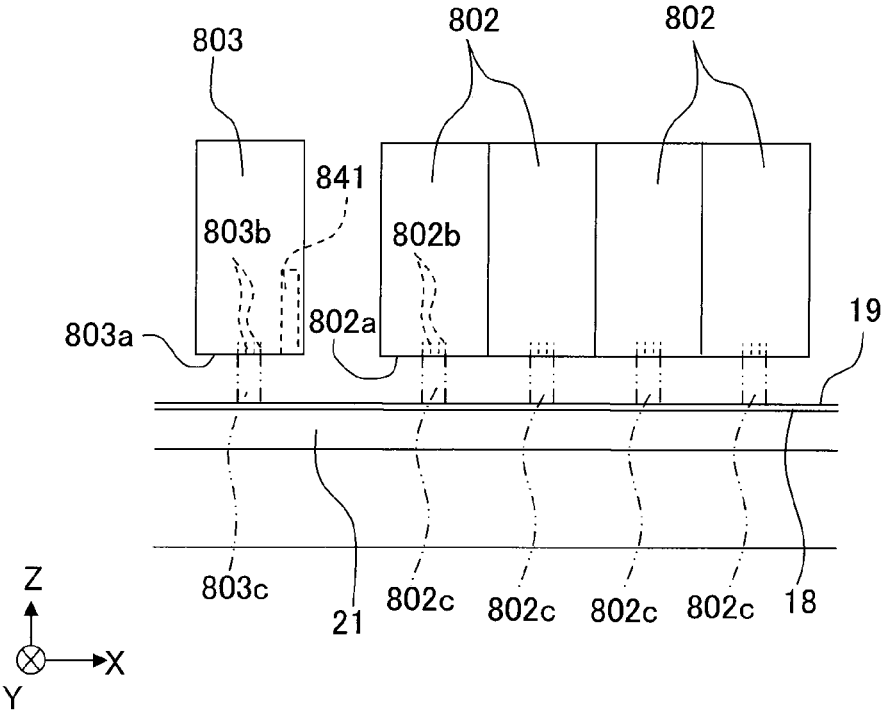
FIG. 12B shows a side view illustrating main components.

In a modified embodiment of the first embodiment described above, as shown in FIGS. 12A and 12B, a plurality of light sources 841 may be contained in a discharge head 803 for discharging the improving liquid. The plurality of light sources 841 are arranged while being directed downwardly so that the ultraviolet rays (ultraviolet light) can be radiated toward the transport surface 19. Accordingly, the ultraviolet rays (ultraviolet light), which are radiated from the light sources 841, are allowed to pass through the space between an area (second area) 803*c* which is disposed between the transport surface 19 and discharge ports 803*b* of a discharge surface 803*a* of the discharge head 803 and areas (first areas) 802*c* which are disposed between the transport surface 19 and discharge ports 802*b* of discharge surfaces 802*a* of the recording heads 802. Therefore, it is possible to obtain the effect which is the same as or equivalent to that of the first embodiment. In the case of this modified embodiment, the entire discharge head 803 is not the discharge mechanism. It is appropriate that the discharge mechanism includes the discharge ports 803*b*, the liquid flow passages connected thereto, and the actuator for applying the discharge energy to the liquid so that the liquid is discharged from the discharge ports 803*b*. The foregoing description has been made about the discharge head 803. However, this arrangement may be adopted for the recording heads 802. In this case, the light sources 841 may be provided upstream from the discharge ports 802*b* of the recording heads 802. In this way, it is possible to obtain the same or equivalent effect. Also in the modified embodiment as described above, the space, through which the ultraviolet rays (ultraviolet light) are allowed to pass, may surround the entire surroundings of the areas 802*c*, 803*c*, or the space may partially surround the surroundings of the areas 802*c*, 803*c*, as in the second embodiment and in the respective modified embodiments of the second embodiment.

In another modified embodiment of the first embodiment described above, the ink-jet printer may be a serial printer in which the recording heads 2 and the discharge head 3 are reciprocatively movable in the Y direction perpendicular to the transport direction A. Further, the recording heads 2 and the discharge head 3 may be arranged and aligned in the Y direction, and the irradiation devices 4 may be integrally constructed between the heads 2, 3 respectively. Further, the recording heads 2, the irradiation device 4, and the discharge head 3 may be constructed independently while being separated from each other respectively.

Figure 13:
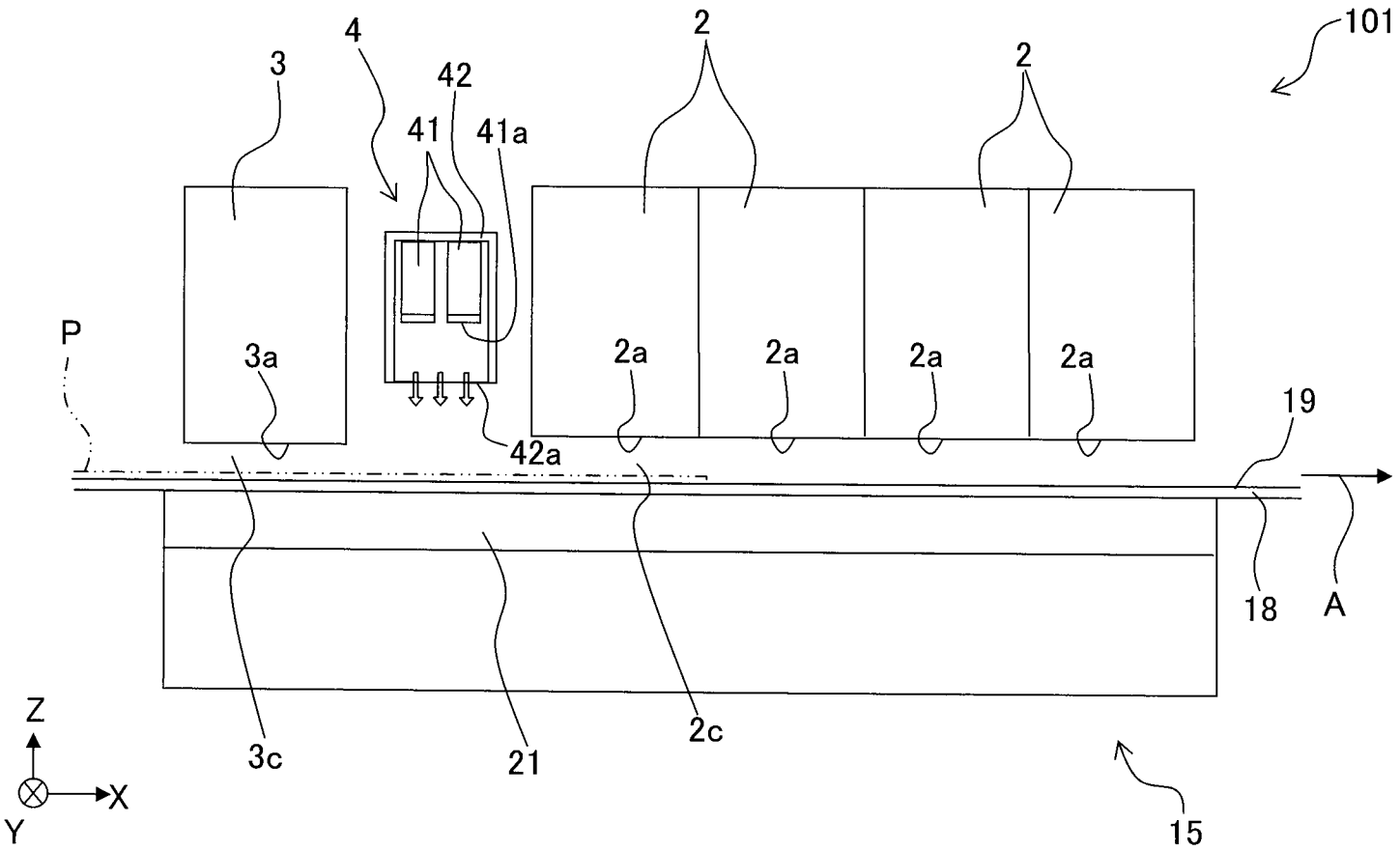
FIG. 13 shows a side view illustrating main components of one of modified embodiments of the first embodiment.

In the ink jet printer of the first embodiment described above, the light emitting port 42*a* of the irradiation device 4, the discharge surfaces 2*a* of the recording heads 2, and the discharge surface 3*a* of the discharge head 3 are positioned at approximately the same height. In other words, the distances from the transport surface 19 to the light emitting port 42*a* and the discharge surfaces 2*a*, 3*a* are approximately equal to one another in the Z direction. However, in a modified embodiment, as shown in FIG. 13, the irradiation device 4 may be arranged so that the light emitting port 42*a* is separated farther from the transport surface 19 as compared with the discharge surfaces 2*a*, 3*a*. In this arrangement, the ultraviolet rays (ultraviolet light) are radiated not only onto the area which is disposed between the area 3C and the area 2C but also onto the area which is disposed above the discharge surfaces 2*a*, 3*a* (in the direction to make separation from the transport surface 19 in the Z direction) between the recording heads 2 and the discharge head 3. The improving liquid mist and the ink mists make a travel or detour to enter not only the areas 3C, 2C but also the area disposed above the discharge surfaces 2*a*, 3*a*. Therefore, when the ultraviolet rays (ultraviolet light) are radiated from the position separated farther from the transport surface 19, it is possible to cure a larger amount of the mists. Similarly, the same or equivalent effect is also obtained in the second embodiment and the third embodiment by arranging the irradiation device 4 in the direction to make farther separation from the transport surface 19.

Figure 14:
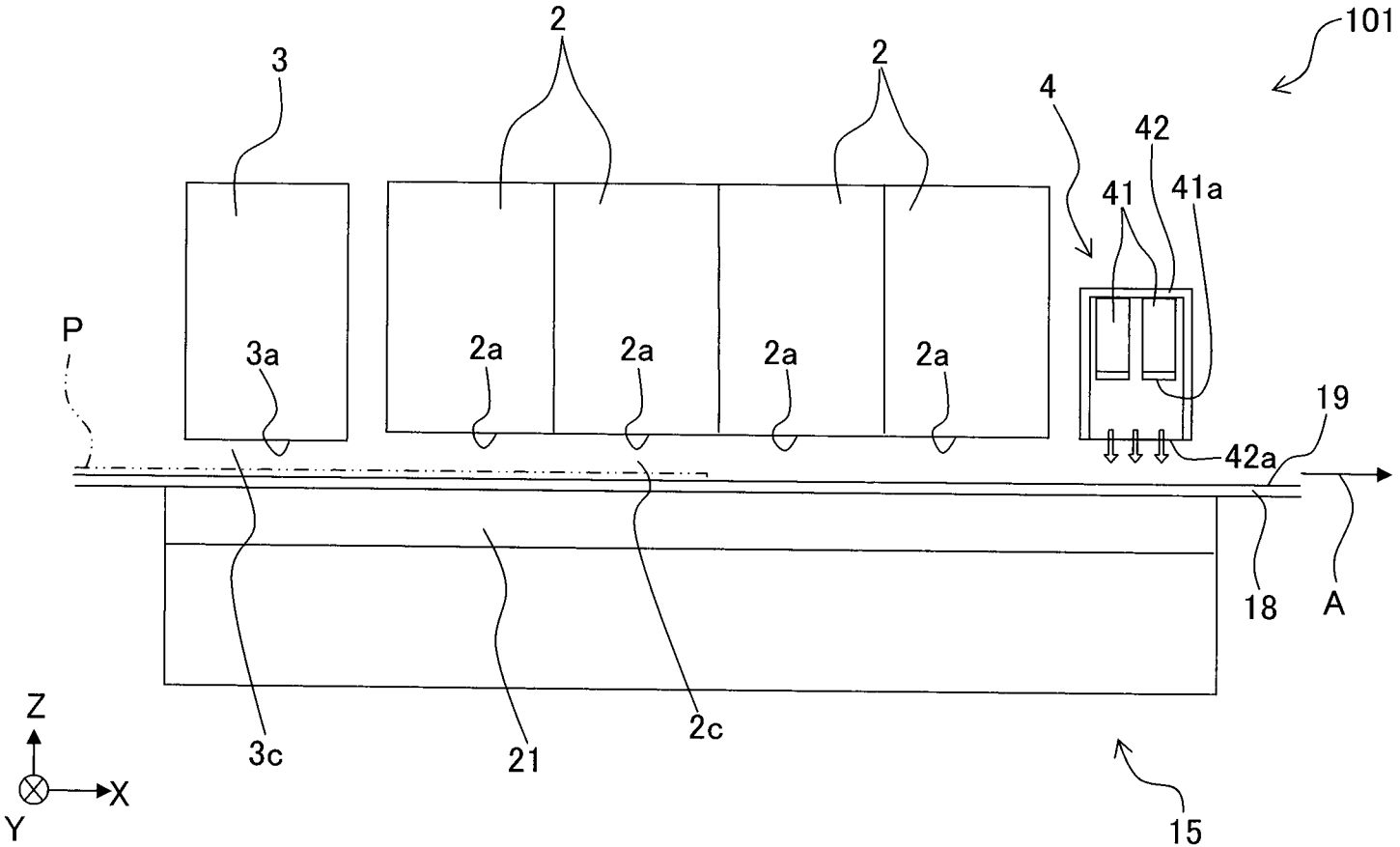
FIG. 14 shows a side view illustrating main components of one of modified embodiments of the first embodiment.

In the ink-jet printer of the first embodiment described above, the irradiation device 4 is arranged between the recording head 2 and the discharge head 3. However, in a modified embodiment, as shown in FIG. 14, the irradiation device 4 may be arranged downstream in the transport direction A from the recording heads 2 and the discharge head 3. As the recording paper P is transported in the transport direction A, the air, which is disposed in the vicinity of the recording medium, flows from the upstream side toward the downstream side in the transport direction A. Therefore, the mists, which are generated or produced from the recording heads and the discharge head 3, also flow from the upstream side toward the downstream side in the transport direction A. Therefore, when the irradiation device 4 is provided on the downstream side, the ultraviolet rays can be effectively radiated onto the mists. In FIG. 14, an ink jet printer provided with one irradiation device 4 is disclosed. However, one more irradiation device may be provided just downstream from the discharge head 3, i.e., between the discharge head 3 and the recording heads 2 to provide an ink-jet printer provided with the two irradiation devices. In this way, when the irradiation devices are provided downstream from the discharge head 3 and the recording heads 2 respectively, it is possible to cure the mists more effectively.

EXAMPLES

In Examples 1 to 8 and Comparative Examples 1 and 2, the printer 101 explained in the first embodiment was used to discharge various inks and improving liquids shown in Tables 2 and 3 below from the recording heads 2 and the discharge head 3. After the discharge, it was observed whether or not any ink solid matter was adhered to the discharge surfaces 2*a*, 3*a*. Further, the quality of the printed image was visually evaluated.

Components shown in Tables 2 and 3 below were firstly mixed with each other respectively, and then they were sufficiently agitated, followed by performing the filtration while applying the pressure by using a filter having a pore size of 3 μm to produce five types of inks M1 to M5 and five types of improving liquids N1 to N5. As shown in Tables 2 and 3, the curable substance K1 or K2 shown in Table 1 was used as the curable substance, and the polymerization initiator J1 or J2 represented by the formulas [J1] and [J2] was used as the polymerization initiator. The unit of the composition of each of the inks and the improving liquids is "% by weight".

TABLE 2

Compositions of Respective Inks

| | Composition of ink | | | | |
|---|---|---|---|---|---|
| | M1 | M2 | M3 | M4 | M5 |
| Coloring agent CAB-O-JET (trade name) 300*1 | 33 | 33 | 33 | 33 | 33 |
| Curable substance K1 | 15 | 15 | — | — | — |
| Curable substance K2 | — | — | 15 | 15 | — |

TABLE 2-continued

| Compositions of Respective Inks | Composition of ink | | | | |
|---|---|---|---|---|---|
| | M1 | M2 | M3 | M4 | M5 |
| Polymerization initiator J1 | 2 | — | 2 | — | — |
| Polymerization initiator J2 | — | 3 | — | 3 | — |
| Ethylene glycol | 15 | 15 | 15 | 15 | 30 |
| Sodium polyoxyethylene lauryl ether sulfate | 1 | 1 | 1 | 1 | 1 |
| Water | 34 | 33 | 34 | 33 | 36 |

*1produced by Cabot, carbon black concentration = 15% aqueous solution.

TABLE 3

| Compositions of Respective Improving Liquids | Composition of improving liquid | | | | |
|---|---|---|---|---|---|
| | N1 | N2 | N3 | N4 | N5 |
| Calcium sulfate | 5 | 5 | 5 | 5 | 5 |
| Trimethylolpropane | 5 | 5 | 5 | 5 | 5 |
| Propylene glycol | 10 | 10 | 10 | 10 | 25 |
| Sodium polyoxyethylene lauryl ether sulfate | 1 | 1 | 1 | 1 | 1 |
| Curable substance K1 | 15 | 15 | — | — | — |
| Curable substance K2 | — | — | 15 | 15 | — |
| Polymerization initiator J1 | 2 | — | 2 | — | — |
| Polymerization initiator J2 | — | 3 | — | 3 | — |
| Water | 62 | 61 | 62 | 61 | 64 |

Example 1

The ink M1 was discharged from the recording head 2 and the improving liquid N1 was discharged from the discharge head 3 to perform the continuous printing on 1000 sheets of regular paper (4200 paper produced by Xerox) in a state in which the ultraviolet rays (ultraviolet light) were radiated from the irradiation device 4 under the condition shown in Table 4 by using the ink jet printer 101. After the discharge, it was observed whether or not any ink solid matter was adhered to the discharge surfaces 2*a*, 3*a*. Further, the quality of the printed image was visually evaluated. The evaluation result was evaluated at four levels of "AA", "A", "B", and "C". Results are shown in Table 4. The evaluation result of Example 1 was "AA".

TABLE 4

| | Ink | Im-proving liquid | Presence or absence of ultraviolet ray radiation | Adhesion of solid matter to discharge surface, quality of printed image |
|---|---|---|---|---|
| Example 1 | M1 | N1 | present | AA |
| Example 2 | M2 | N2 | present | AA |
| Example 3 | M3 | N3 | present | AA |
| Example 4 | M4 | N4 | present | AA |
| Example 5 | M1 | N5 | present | B |
| Example 6 | M2 | N5 | present | B |
| Example 7 | M5 | N1 | present | A |
| Example 8 | M5 | N2 | present | A |
| Comp. Ex. 1 | M5 | N5 | present | C |
| Comp. Ex. 2 | M1 | N1 | absent | C |

In this procedure, the evaluation "AA" is estimated when any solid matter brought about by the coagulation of the pigment is not confirmed at all on both of the discharge surface 2*a* of the recording head 2 and the discharge surface 3*a* of the discharge head 3, and the quality of the printed image is satisfactory as well. The quality of the printed image referred to herein relates to the accuracy of the landing positions of the improving liquid and the ink discharged onto the recording paper. The evaluation "A" is estimated when any solid matter brought about by the coagulation of the pigment is not observed on the discharge surface 2*a* of the recording head 2, but any solid matter brought about by the coagulation of the pigment is observed on the discharge surface 3*a* of the discharge head, and the quality of the printed image is slightly deteriorated although the deterioration is at such a level that no problem arises in the practical use. The evaluation "B" is estimated when any solid matter brought about by the coagulation of the pigment is not observed on the discharge surface 3*a* of the discharge head 3, but any solid matter brought about by the coagulation of the pigment is observed on the discharge surface 2*a* of the recording head 2, and the printed image is deteriorated although no problem arises in the practical use. The evaluation "C" is estimated when any solid matter brought about by the coagulation of the pigment is observed on both of the discharge surface 2*a* of the recording head 2 and the discharge surface 3*a* of the discharge head 3, and the printed image is conspicuously deteriorated at such a level that the deterioration cannot be permitted in the practical use.

Examples 2 to 4

The continuous printing was performed on 1000 sheets of regular paper under the condition shown in Table 4 in the same manner as in Example 1, and then the evaluation was performed for the adhesion of any solid matter to the discharge surface and the quality of the printed image. Results are shown in Table 4. The evaluation was also "AA" in Examples 2 to 4 in the same manner as in Example 1. As described above, in Examples 1 to 4, the ultraviolet rays were radiated from the irradiation device 4 during the printing, and the curable substance was contained in both of the ink and the improving liquid. Therefore, the satisfactory evaluation was obtained.

Examples 5 and 6

The continuous printing was performed on 1000 sheets of regular paper under the condition shown in Table 4 in the same manner as in Example 1, and then the evaluation was performed for the adhesion of any solid matter to the discharge surface and the quality of the printed image. Results are shown in Table 4. The evaluation was "B" for Examples 5 and 6 for the following reason. That is, the curable substance was not contained in the improving liquid N5 discharged from the discharge head 3 disposed upstream in the transport direction A. Therefore, the mist of the improving liquid N5 was not cured even when the mist of the improving liquid N5 passed through the area irradiated with the ultraviolet rays. The mist of the improving liquid N5 was adhered to the discharge surface 2*a* of the recording head 2 as it was. In other words, the solid matter, which was formed such that a part of the mist of the improving liquid N5 adhered to the discharge surface 2*a* was brought in contact with the ink to coagulate the pigment contained in the ink, was adhered to the vicinity of the discharge ports 2*b* of the discharge surface 2*a*. As a result, the solid matter disturbs the ink discharge, and the deterioration of the quality of the printed image was confirmed although the deterioration was to such an extent that no problem arose in the practical use.

Examples 7 and 8

The continuous printing was performed on 1000 sheets of regular paper under the condition shown in Table 4 in the same manner as in Example 1, and then the evaluation was performed for the adhesion of any solid matter to the discharge surface and the quality of the printed image. Results are shown in Table 4. The evaluation was "A" for Examples 7 and 8 for the following reason. That is, any solid matter brought about by the coagulation of the pigment contained in the ink was not observed on the discharge surface 2*a* of the recording head 2 in the same manner as in Examples 1 to 4 described above, because the curable substance was contained in the improving liquid N1, N2 discharged from the discharge head 3 disposed upstream in the transport direction A. However, the curable substance was not contained in the ink M5 discharged from the recording head 2. Therefore, the mist of the ink M5 was not cured even when the mist of the ink M5 passed through the area irradiated with the ultraviolet rays. The mist of the ink M5 was adhered to the discharge surface 3*a* of the discharge head 3 as it was. In other words, the solid matter, which was formed such that a part of the mist of the ink M5 adhered to the discharge surface 3*a* was brought in contact with the improving liquid to coagulate the pigment contained in the ink, was adhered to the vicinity of the discharge ports 3*b* of the discharge surface 3*a*. As a result, the solid matter disturbs the improving liquid discharge, and any partial deviation was caused with respect to the landing position of the ink due to the disturbance of the landing position of the improving liquid. The deterioration of the quality of the printed image was slightly confirmed although the deterioration was to such an extent that no problem arose in the practical use. In Examples 7 and 8, the landing position of the transparent improving liquid was merely disturbed, and the landing position of the ink was not disturbed.

Comparative Example 1

The continuous printing was performed on 1000 sheets of regular paper under the condition shown in Table 4 in the same manner as in Example 1, and then the evaluation was performed for the adhesion of any solid matter to the discharge surface and the quality of the printed image. Results are shown in Table 4. The evaluation was "C" for Comparative Example 1 for the following reason. That is, the curable substance was not contained in both of the ink discharged from the recording head 2 and the improving liquid discharged from the discharge head 3. In other words, the solid matter, which was formed such that the pigment contained in the ink was coagulated, was found on each of the discharge surfaces 2*a*, 3*a* of the both heads. The discharge from the both heads was disturbed due to the solid matter, and the conspicuous deterioration of the quality of the printed image was confirmed at such a level that the deterioration was unallowable in the practical use.

Comparative Example 2

The continuous printing was performed on 1000 sheets of regular paper under the condition shown in Table 4 in the same manner as in Example 1, and then the evaluation was performed for the adhesion of any solid matter to the discharge surface and the quality of the printed image. Results are shown in Table 4. The evaluation was "C" for Comparative Example 2 for the following reason. That is, the ultraviolet rays were not radiated from the irradiation device 4, even when the curable substance was contained in both of the ink discharged from the recording head 2 and the improving liquid discharged from the discharge head 3. In other words, the solid matter, which was formed such that the pigment contained in the ink was coagulated, was found on each of the discharge surfaces 2*a*, 3*a* of the both heads. The discharge from the both heads was disturbed due to the solid matter, and the conspicuous deterioration of the quality of the printed image was confirmed at such a level that the deterioration was unallowable in the practical use.

What is claimed is:

1. An image forming apparatus for forming an image on a recording medium, the image forming apparatus comprising:

a first discharge head configured to discharge, toward the recording medium, an ink containing a coloring agent while producing an ink mist;

a second discharge head configured to discharge, toward the recording medium, a liquid, which improves image quality and which contains a component for coagulating or depositing the coloring agent, while producing a liquid mist;

an energy emitting device configured to emit active energy and irradiate at least one of the ink mist and liquid mist with the active energy; and a transport mechanism configured to transport the recording medium to a position opposed to the first discharge head and the second discharge head, wherein the energy emitting device comprises a plurality of light sources, wherein the plurality of light sources are opposed to the transport mechanism and arranged in a staggered form in a direction perpendicular to a transport direction in which the recording medium is transported by the transport mechanism, wherein at least one of the ink and the liquid contains a curable substance which is curable by being irradiated with the active energy, and wherein at least one of the ink mist and the liquid mist is cured.

2. The image forming apparatus according to claim 1, wherein the energy emitting device is arranged to make the active energy pass through a space between the first discharge head and the second discharge head.

3. The image forming apparatus according to claim 1, wherein:

the first discharge head and the second discharge head are arranged opposingly to the transport mechanism; and the energy emitting device is arranged to make the active energy, which is emitted from the energy emitting device, pass through an area between a first area which is disposed between the first discharge head and the transport mechanism and a second area which is disposed between the second discharge head and the transport mechanism.

4. The image forming apparatus according to claim 1, wherein:

the first discharge head has an ink discharge surface for discharging the ink, the second discharge head has a liquid discharge surface for discharging the liquid, and the energy emitting device has an active energy emitting port for emitting the active energy; and the ink discharge surface, the liquid discharge surface, and the active energy emitting port are arranged opposingly to the transport mechanism.

5. The image forming apparatus according to claim 4, wherein:

the first discharge head, the second discharge head, and the energy emitting device are arranged in a transport direction in which the recording medium is transported; and the energy emitting device is arranged between the first discharge head and the second discharge head.

6. The image forming apparatus according to claim 4, wherein the energy emitting port is arranged between the ink discharge surface and the liquid discharge surface in a transport direction in which the recording medium is transported.

7. The image forming apparatus according to claim 1, wherein:

the first discharge head and the second discharge head are arranged opposingly to the transport mechanism; and the energy emitting device is arranged to make the active energy pass through a surrounding area which surrounds at least one of a first area which is disposed between the first discharge head and the transport mechanism and a second area which is disposed between the second discharge head and the transport mechanism.

8. The image forming apparatus according to claim 1, wherein:

the first discharge head has an ink discharge surface for discharging the ink, the second discharge head has a liquid discharge surface for discharging the liquid, and the energy emitting device has an active energy emitting port for emitting the active energy; and the active energy emitting port is arranged around at least one of the ink discharge surface and the liquid discharge surface.

9. The image forming apparatus according to claim 4, wherein a length of the active energy emitting port is longer than at least one of a length of the ink discharge surface and a length of the liquid discharge surface in a direction perpendicular to a transport direction in which the recording medium is transported by the transport mechanism.

10. The image forming apparatus according to claim 4, wherein:

the first discharge head, the second discharge head, and the energy emitting device are arranged in a transport direction in which the recording medium is transported; and the second discharge head is arranged upstream from the first discharge head in the transport direction.

11. The image forming apparatus according to claim 4, further comprising:

a shielding member through which the active energy is not transmitted, wherein:

the shielding member is arranged between the active energy emitting port and the transport mechanism; and the shielding member is disposed closely to the transport mechanism as compared with the first discharge head and the second discharge head.

12. The image forming apparatus according to claim 4, wherein:

the first discharge head, the second discharge head, and the energy emitting device are arranged in a transport direction in which the recording medium is transported; and the energy emitting device is arranged downstream from at least one of the first discharge head and the second discharge head in the transport direction.

13. The image forming apparatus according to claim 1, wherein the curable substance is included in only one of the ink and the liquid.

14. The image forming apparatus according to claim 13, wherein the curable substance is included in only the liquid.

15. The image forming apparatus according to claim 1, wherein the curable substance is included in both of the ink and the liquid.

16. An image forming method for forming an image on a recording medium, the image forming method comprising:

discharging, toward the recording medium, an ink containing a coloring agent while producing an ink mist;

discharging, toward the recording medium, a liquid, which improves image quality and which contains a component for coagulating or depositing the coloring agent, while producing a liquid mist; and emitting active energy, wherein at least one of the ink and the liquid contains a curable substance which is curable by being irradiated with the active energy, wherein at least one of the ink mist and the liquid mist is irradiated with the active energy, wherein at least one of the ink mist and the liquid mist is curable by being irradiated with the active energy, and wherein the emission of the energy is started simultaneously with or before start of any one of the discharge of the ink and the discharge of the liquid, and the emission of the energy is completed after at least one of the ink mist and the liquid mist is further cured after completion of the discharge of the ink and the discharge of the liquid.

17. The image forming method according to claim 16, wherein the ink is discharged onto the recording medium onto which the liquid has been discharged.

* * * * *